US005376508A

United States Patent [19]

Yamada et al.

[11] Patent Number: 5,376,508

[45] Date of Patent: Dec. 27, 1994

[54] METHOD FOR FORMING A SILVER HALIDE COLOR PHOTOGRAPHIC IMAGE

[75] Inventors: Yoshitaka Yamada; Satoru Shimba; Hiroshi Shimazaki, all of Hino, Japan

[73] Assignee: Konica Corporation, Japan

[21] Appl. No.: 129,024

[22] Filed: Sep. 20, 1993

Related U.S. Application Data

[63] Continuation of Ser. No. 843,810, Feb. 28, 1992, abandoned.

[30] Foreign Application Priority Data

Mar. 4, 1991 [JP] Japan ..... 3-037613

[51] Int. Cl.[5] ..... G03C 7/46; G03C 1/08; G03C 7/26; G03C 1/005

[52] U.S. Cl. ..... 430/383; 430/388; 430/389; 430/585; 430/557; 430/508; 430/550

[58] Field of Search ..... 430/383, 388, 389, 504, 430/507, 508, 550, 557, 585, 587, 595

[56] References Cited

U.S. PATENT DOCUMENTS

| | | | |
|---|---|---|---|
| 3,725,072 | 4/1973 | Yoshida et al. | 430/388 |
| 5,023,169 | 6/1991 | Hirabayashi et al. | 430/557 |
| 5,091,294 | 2/1992 | Nishijimo et al. | 430/507 |

FOREIGN PATENT DOCUMENTS

| | | | |
|---|---|---|---|
| 0283324 | 9/1988 | European Pat. Off. | 430/557 |
| 295716 | 12/1988 | European Pat. Off. . | |
| 160449 | 7/1987 | Japan . | |
| 1158441 | 6/1989 | Japan | 430/557 |
| 3125141 | 5/1991 | Japan | 430/389 |
| 3144443 | 6/1991 | Japan | 430/389 |

*Primary Examiner*—Charles L. Bowers, Jr.
*Assistant Examiner*—J. Pasterczyk
*Attorney, Agent, or Firm*—Jordan B. Bierman

[57] ABSTRACT

Disclosed is a method for forming a silver halide color photographic image comprising:

exposing a silver halide color photographic light-sensitive material for photographing which comprises a support and provided thereon at least one blue-sensitive silver halide emulsion layer (B layer), at least one green-sensitive silver halide emulsion layer (G layer) and at least one red-sensitive silver halide emulsion layer (R layer) to light to obtain a latent image; processing said latent image to obtain a color negative image;

printing said color negative image on a silver halide color photographic light-sensitive material for printing which comprises a support and provided thereon a yellow color-forming layer (Y layer), a magenta color-forming layer (M layer) and a cyan color-forming layer (C layer) to obtain a color photographic image; wherein:

(A) the spectral sensitivity distribution of the G layer $S_G(\lambda)$ has a maximum value at a certain point $\lambda_{Gmax}$ within the wavelength region 525–560 nm, and the spectral sensitivity of the G layer at 570 nm $S_{G570}$ accounts for 40% or less of said maximum value; and (B) the spectral density distribution of a dye formed in the Y layer by processing said color photographic light-sensitive material for printing $S_Y(1)$ has a maximum value at a certain point $1_U{}^{50}$ within the wavelength region 430–460 nm, and said maximum value is reduced to half at a certain point $1_Y{}^{50}$ within the longer wavelength region 480–500 nm. By the method of the invention, it is possible to obtain a color photographic image in which colors, in particular, yellow and skin color, is reproduced with an extremely high degree of accuracy.

7 Claims, No Drawings

METHOD FOR FORMING A SILVER HALIDE COLOR PHOTOGRAPHIC IMAGE

This application is a continuation, of application Ser. No. 07/8433810 filed Feb. 28, 1992, now abandoned.

FIELD OF THE INVENTION

The present invention relates to a silver halide color photographic light-sensitive material, specifically to a silver halide color photographic light-sensitive material improved in hue reproducibility.

BACKGROUND OF THE INVENTION

In recent years, silver halide color photographic light-sensitive materials have been significantly improved in image quality. The light-sensitive materials now on the market are excellent in graininess and sharpness, and it seems that photoprints (of service size) and slide films obtained from these materials almost satisfy users' requirements.

As for color reproducibility, however, there is yet room for improvement. Though light-sensitive materials have come to be able to provide a dye image of a higher purity (they can provide an image of a color which is vivid, sometimes far more vivid than the color of a subject), they cannot reproduce accurately some hues that have been regarded as difficult to be reproduced in a photograph. When photographing is performed with conventional light-sensitive materials, a color of the purple family that reflects light of not less than 600 nm in wavelength (a color having anomalous reflectance) such as purple and bluish purple, and a color of the green family such as green and yellowish green are likely to be reproduced as colors entirely different from original ones.

Meanwhile, color reproduction is greatly affected by spectral sensitivity distribution and the interimage effect (hereinafter referred to as IIE). Japanese Patent Publication Open to Public Inspection (hereinafter referred to as Japanese Patent O.P.I. Publication) No. 2537/1975 and other publications disclose the use of a DIR compound for the manifestation of an IIE. A DIR compound is a compound that releases a development inhibitor or its precursor upon a coupling reaction with an oxidized color developing agent. A development inhibitor or its precursor released from a DIR compound hinders the development of other color-forming layers.

In the case of color negative films, a dye image can be prevented from becoming impure by the use of a colored coupler in an amount large enough to cancel an unnecessary absorption (a secondary absorption). An effect similar to IIE can be produced by the use of a sufficient amount of a colored coupler.

However, a large amount of a colored coupler inevitably increases the minimum density of a film, leading to difficulty in color or density correction at the time of printing, which eventually prolongs printing time or deteriorates the quality of the resulting photoprint.

The use of a colored coupler is effective only in improving color purity. A diffusible DIR, a compound capable of releasing a development inhibitor (or its precursor) that has a higher diffusibility, has come to be employed widely for its contribution to color purity improvement. This compound, however, has a defect such that it causes the hue of a subject to be reproduced differently if the direction in which a development inhibitor is diffused is not adequately controlled.

Japanese Patent Examined Publication No. 6207/1974 discloses bringing the spectral sensitivity distribution of each of blue- and red-sensitive silver halide emulsion layers (hereinafter abbreviated as blue- and red-sensitive layers) close to that of a green-sensitive silver halide emulsion layer (hereinafter abbreviated as a green-sensitive layer) by using a filter layer or the like in order to minimize variation in color reproduction caused by change in light source conditions.

This method is effective to some extent in preventing the color reproducibility of a light-sensitive material for photographing from varying due to a change in color temperature. However, by this method, it is impossible to improve the reproducibility for colors which are regarded as difficult to be reproduced.

In addition, by this method, sensitivity is considerably lowered, and, since the spectral sensitivity distribution curves of color-sensitive layers are caused to overlap with one another, the range of color reproduction narrows, and as a result, a color having a higher saturation cannot be reproduced accurately.

For accurate reproduction of a hue, shifting the spectral sensitivity distribution of a red-sensitive layer to the shorter wavelength region is important, since it has an effect of bringing the peak wavelength of the spectral sensitivity distribution of a light-sensitive material closer to that of the spectral sensitivity distribution of a human eye. This is especially important for the exact reproduction of a color that has anomalous reflectance, i.e., bluish purple (e.g. photographic reproduction of a bluish purple flower).

However, as mentioned above, when the spectral sensitivity distribution of a red-sensitive layer is shifted to the shorter wavelength region, a light-sensitive material cannot provide a dye image with a higher saturation; in particular, it cannot perform exact reproduction of skin color. When photographing is performed with such a light-sensitive material, skin color is reproduced to a color which is lacking healthy redness that is peculiar to the skin of a human being.

Japanese Patent O.P.I. Publication Nos. 20926/1978 and 131937/1984 each disclose a technique of bringing the spectral sensitivity distribution of a red-sensitive layer closer to that of a green-sensitive layer. However, this technique is not effective in improving color reproducibility, and involves the above-mentioned problems. Aiming at improving reproducibility for bluish green, Japanese Patent O.P.I. Publication No. 181144/1990 specifies a difference in sensitivity at 480 nm between a blue-sensitive layer and a green-sensitive layer and the density of a yellow filter layer.

Japanese Patent O.P.I. Publication No. 160449/1987 specifies IIE manifestation direction for each color-sensitive layer.

Japanese Patent O.P.I. Publication No. 160448/1987 discloses a method in which a cyan layer is provided to allow an IIE to be manifested in a red-sensitive layer, whereby the red-sensitive layer has a spectral sensitivity distribution close to that of a human eye. This method is accompanied by a problem such that the production cost is high due to an increased coating weight of silver and more complicated production procedures which are ascribable to the provision of an IIE manifesting layer. In addition, effects obtained by this method are not significant.

Meanwhile, to reproduce skin color more accurately, it is important to make the spectral sensitivity distribution curve of a G layer short-tailed in the longer wavelength region. If the spectral sensitivity distribution curve of a G layer is short-tailed in the longer wavelength region, the layer receives less light in photographing a red subject, causing the resulting photoprint to have a strong tinge of magenta. However, when the spectral sensitivity distribution curve of a G layer is short-tailed in the longer wavelength region, accurate reproduction of yellow cannot be performed. In such case, yellow in a photoprint has a tinge of magenta. Vivid yellow, such as the color of a lemon, cannot be reproduced exactly by this method.

As is understood from the foregoing, any of the conventional methods was unsatisfactory in color reproducibility. Under such circumstances, there has been a strong demand for a light-sensitive material with improved color reproducibility.

SUMMARY OF THE INVENTION

The object of the invention is to provide a method of forming a silver halide color photographic image which allows the color of a subject, in particular, skin color and yellow, to be reproduced in a photograph with a high degree of accuracy.

The inventors made extensive studies, and have found that the above problem can be solved by a method of forming a silver halide color photographic image which comprises: exposing a silver halide color photographic light-sensitive material for photographing which comprises a support and provided thereon at least one blue-sensitive silver halide emulsion layer (B layer), at least one green-sensitive silver halide emulsion layer (G layer) and at least one red-sensitive silver halide emulsion layer (R layer) to light to obtain a latent image; processing said latent image to obtain a color negative image; printing said color negative image on a silver halide color photographic light-sensitive material for printing which comprises a support and provided thereon a yellow color-forming layer (Y layer), a magenta color-forming layer (M layer) and a cyan color-forming layer (C layer) to obtain a color photographic image; wherein: (A) the spectral sensitivity distribution of the G layer $S_G(\lambda)$ has a maximum value ($S_{Gmax}$) at a certain point $\lambda_{Gmax}$ within the wavelength region 525–560 nm, and the spectral sensitivity of the G layer at 570 nm ($S_{G570}$) accounts for 40% or less of said maximum value; and (B) the spectral density distribution of a dye formed in the Y layer by processing said color photographic light-sensitive material $S_Y(\lambda)$ has a maximum value $S_{Ymax}$ at a certain point $\lambda_{Ymax}$ within the wavelength region 430–460 nm, and said maximum value is reduced to half at a certain point $\lambda_Y{}^{50}$ within the longer wavelength region 480–500 nm.

The present invention will be described in more detail.

DETAILED DESCRIPTION OF THE INVENTION

In the invention, the spectral sensitivity distribution of a color-sensitive layer is obtained by the following method: A light-sensitive material is exposed to spectral light in the increments of several nm over the wavelength region 380–700 nm. At each wavelength, the reciprocal of an exposure that provides a density higher than the minimum density by 0.70 is obtained. Sensitivity is defined as such a reciprocal. A sensitivity distribution curve is obtained by plotting sensitivity against wavelength. In the invention, the spectral sensitivity distribution curve of a B layer culminates preferably at a certain point within the wavelength region 400–470 nm, still preferably 410–460 nm.

The spectral sensitivity distribution of a G layer is required to have a maximum value at a certain point $\lambda_{Gmax}$ within the wavelength region 525–560 nm, preferably 530–555 nm, still preferably 535–550 nm. Further, the spectral sensitivity of a G layer at 570 nm must account for 40% or less, preferably 20% or less, still preferably 15% or less, of the sensitivity at $\lambda_{Gmax}$. When a G layer satisfies these requirements, it is possible to obtain a photoprint in which skin color is reproduced to a bright color tinged with pink.

As mentioned above, in the invention, spectral sensitivity is defined as the reciprocal of an exposure which provides a density higher than the minimum density by 0.70. In the invention, it is preferred that the spectral sensitivity distribution of a G layer satisfy the above requirements also when spectral sensitivity is defined as the reciprocal of an exposure which provides a density higher than the minimum density by 0.30 or 1.0.

There is no specific restriction as to the spectral sensitivity distribution of an R layer, but it preferably culminates at a certain point within the wavelength region 590–640 nm, preferably 600–630 nm.

When the spectral sensitivity distribution of an R layer satisfies the above requirement, hues, in particular purple, can be reproduced with a high degree of accuracy.

Various methods can be employed for allowing each of B, G and R layers to have the above-mentioned specific spectral sensitivity distribution. Examples include: spectrally sensitizing a silver halide by using a sensitizing dye having an absorption spectrum in a desired wavelength region; optimizing the halide composition or halide distribution of a silver halide; and adding an optical absorber to a light-sensitive material. These methods may be employed in combination.

In the present invention, conventional spectral sensitizing dyes may be employed. Preferred examples include cyanine dyes, merocyanine dyes and composite merocyanine dyes.

Preferred examples of sensitizing dyes to be employed for allowing a G layer to have the above-mentioned specific spectral sensitivity distribution are given below:

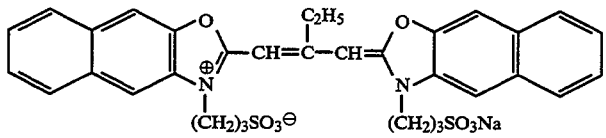

D-1

-continued
D-2
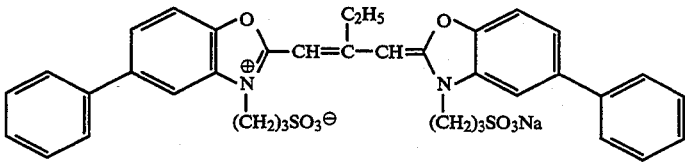
D-3
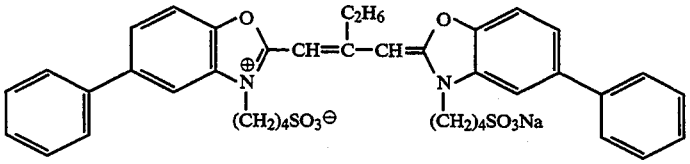
D-4
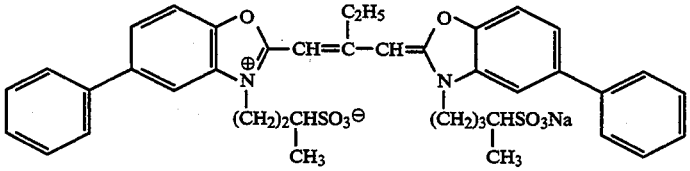
D-5
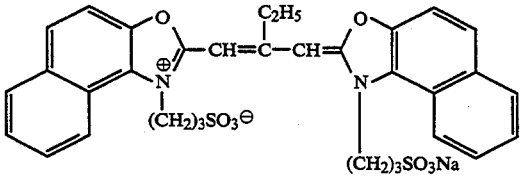
D-6
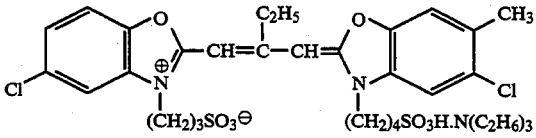
D-7
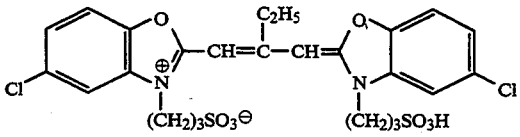
D-8
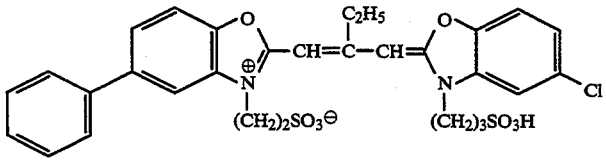
D-9
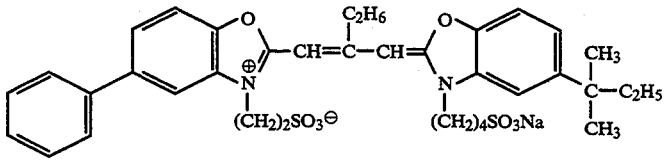
D-10
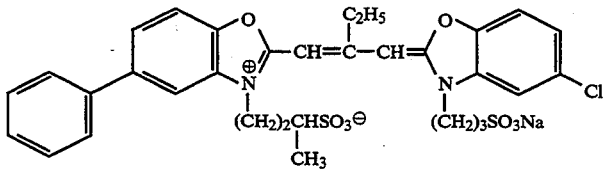

-continued
D-11
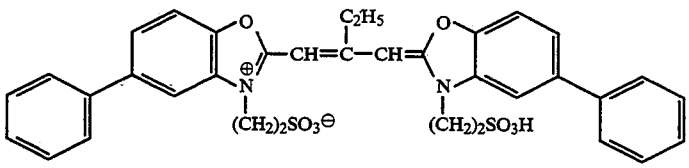
D-12
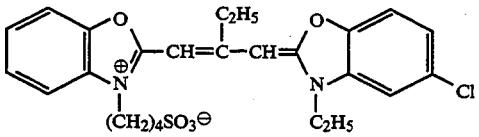
D-13
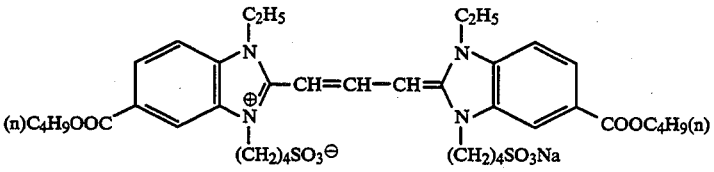
D-14
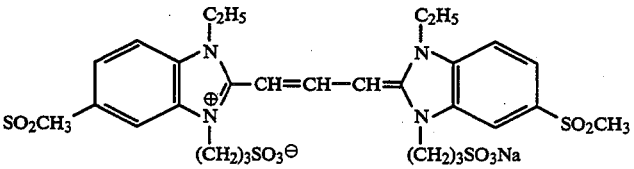
D-15
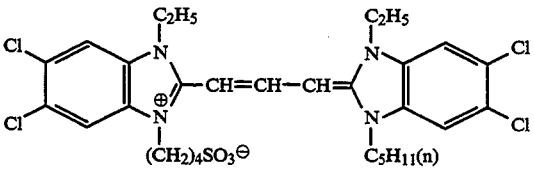
D-16
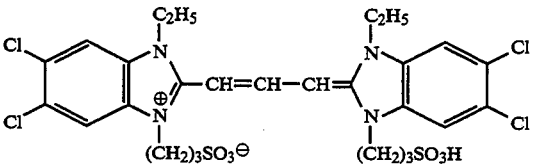
D-17
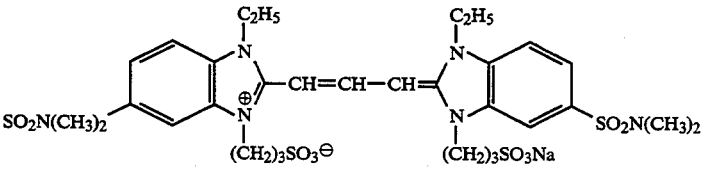
D-18
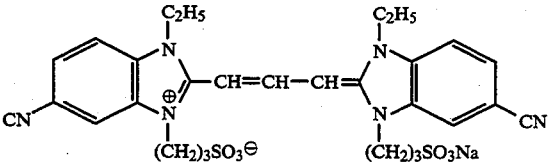
D-19
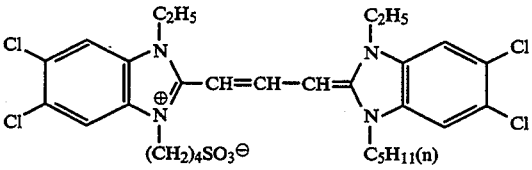

-continued

D-20

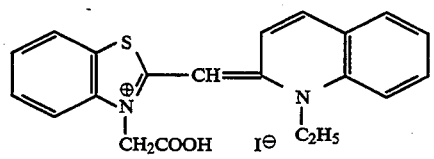

D-21

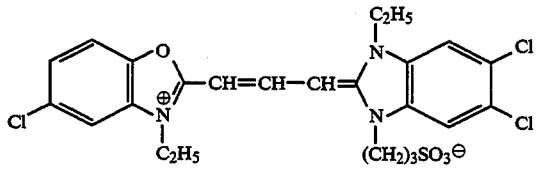

D-22

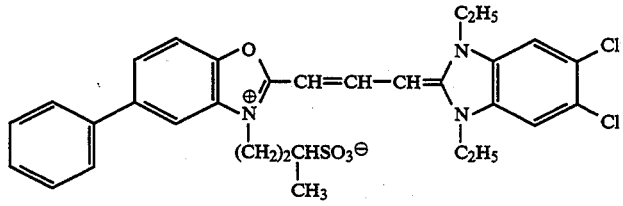

In the invention, any of conventional light-sensitive silver halides can be employed for each light-sensitive layer of a silver halide color photographic light-sensitive material for photographing; examples include silver iodobromide, silver chloroiodobromide, silver bromide and silver chloride. Of them, preferred is silver iodobromide.

Next, an explanation will be made on a color photographic light-sensitive material for printing.

In the invention, a Y layer is preferably a blue-sensitive layer, an M layer is preferably a green-sensitive layer and a C layer is preferably a red-sensitive layer. Each light-sensitive layer consists preferably of a silver chlorobromide emulsion, in particular, a silver chloride or silver chlorobromide emulsion with an average silver chloride content of 90 mol % or more. In the invention, it is essential that the spectral density distribution $S_Y(\lambda)$ of a dye formed in a Y layer have a maximum value $S_{Ymax}$ at a certain point within the wavelength region 430–460 nm; and that said maximum value is reduced to half at a certain point $\lambda_Y^{50}$ within the longer wavelength region 480–500 nm, preferably 485–495 nm. As a color developing agent, use can be made of an aromatic primary amine color developing agent that has conventionally been employed in the art, preferably a p-phenylenediamine derivative.

Representative examples of usable color developing agent are given below:

D-1: N,N-diethyl-p-phenylenediamine
D-2: 2-amino-5-diethyleneaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: 4-amino-3-methyl-N-ethyl-N-[β-(methanesulfoneamide)ethyl]aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above p-phenylenediamine derivatives, especially preferred is 4-amino-3-methyl-N-ethyl-N-[β(methanesulfoneamide)ethyl]aniline.

The spectral density distribution of a Y layer can be obtained by the following method:

A light-sensitive material for printing was exposed to monochromatic light, followed by processing, thus obtaining a sample in which a yellow dye was formed. Exposure was controlled such that the density of the yellow dye at the peak wavelength would become 1.0. It should be noted that the shape of a spectral absorption curve depends on reflectance density, and the measurement value may vary according to measurement method.

In the invention, the spectral density of a Y layer is measured under the conditions prescribed in JISZ-8722 (1982); Arithmetic conditions of illumination and light absorption.

As for a light-sensitive material for printing comprising a transparent support, the measurement is conducted while controlling exposure such that the density of a yellow dye formed in a Y layer would be 1.0 at the peak wavelength.

The monochromatic light (blue, green, red) exposure as referred to herein means exposure to light with a spectral energy corresponding to the spectral sensitivity distribution of each light-sensitive emulsion layer. For blue light exposure, use can be made of a Wratten gelatin filter W-98. For green light exposure and red light exposure, use can be made of W-99 and W-26 filters, respectively.

C and M layers each may contain a conventional coupler. It is preferred that an M layer contain a pyrazolotriazole-based magenta coupler represented by the following Formula M-I:

Formula M-I

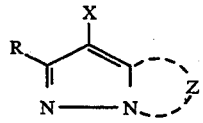

In the formula, Z represents a group of non-metallic atoms necessary for forming a nitrogen-containing heterocyclic ring; X represents a hydrogen atom or a group capable of being released therefrom upon a coupling reaction with an oxidized developing agent; and R represents a hydrogen atom or a substituent. The ring formed by Z may contain a substituent.

The substituent represented by R is not critical. Usable substituents include an alkyl group, an aryl group, an anilino group, an acylamino group, a sulfoneamide group, an alkylthio group, an arylthio group, an alkenyl group and a cycloalkyl group, a halogen atom, a cycloalkenyl group, an alkinyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imido group, an ureido group, a sulfamoylamino group, an alkoxycarbonylamino group, an aryloxycarbonylamino group, an alkoxycarbonyl group, an aryloxycarbonyl group, a heterocyclic thio group, a spiro compound radical and a bridging hydrocarbon compound radical.

Preferred examples of the substituent represented by R, the group represented by X, the ring formed by Z, the substituent contained in Z, and the magenta coupler represented by M-I are given in European Patent No. 0,273,712, page 3, line 18 to page 6, line 7.

Example compounds M-1 to 61 described in European Patent No. 0,273,712, pages 6 to 21, as well as example compounds 1 to 223 given on pages 36 to 92 of the same publication are also usable in the invention.

The above coupler can be prepared by methods described in Journal of the Chemical Society, Perkin, I (1977), pages 2047 to 2052, U.S. Pat. No. 3,725,067, Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988.

The above coupler may be employed in combination with another kind of magenta coupler. Its amount is normally $1\times10^{-3}$ to 1 mol, preferably $1\times10^{-2}$ to $8\times10^{-1}$ mol, per mol silver.

In the invention, conventional yellow couplers may be used. The spectral absorption characteristics depend not only on the kind of coupler but also on the kind of high-boiling solvent and the method of dispersion, but, in the invention, it is preferable to employ a yellow coupler represented by the following Formula I:

Formula I

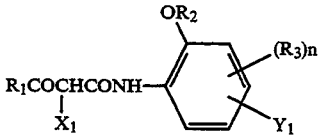

In the formula, $R_1$ represents an alkyl group, a cycloalkyl group or an aryl group; $R_2$ represents an alkyl group, a cycloalkyl group, an acyl group or an aryl group; $R_3$ represents a group capable of being a substituent on in a benzene ring; n represents 0 or 1; $X_1$ represents a group capable of being released therefrom upon a coupling reaction with an oxidized developing agent; and $Y_1$ represents a ballast group.

An explanation will be made on the yellow coupler represented by Formula I.

Examples of the alkyl group represented by $R_1$ include methyl, ethyl, isopropyl, t-butyl and dodecyl. The alkyl group represented by $R_1$ may have a substituent. Suitable substituents include a halogen atom, an aryl group, an alkoxy group, an aryloxy group, an alkylsulfonyl group, an acylamino group and a hydroxyl group.

Examples of the cycloalkyl group represented by $R_1$ include cyclopropyl, cyclohexyl and adamantyl.

Examples of the aryl group represented by $R_1$ include phenyl. A branched alkyl group is preferable as $R_1$.

Examples of the alkyl group and the cycloalkyl group represented by $R_2$ are the same as those of the alkyl group and the cycloalkyl group represented by $R_1$. The aryl group represented by $R_2$ may be phenyl. The alkyl group, the cycloalkyl group and the aryl group represented by $R_2$ each may have the same substituent as that for $R_1$.

Examples of the acyl group include acetyl, propionyl, butylyl, hexanoyl and benzoyl.

An alkyl group or an aryl group is preferable as $R_2$. The most preferable is an alkyl group, in particular, a lower alkyl group with 1 to 5 carbon atoms.

Examples of the group represented by $R_3$ include a halogen atom (e.g. chlorine), an alkyl group (e.g. ethyl, i-propyl, t-butyl), an alkoxy group (e.g. methoxy), an aryloxy (e.g. phenyloxy), an acyloxy group (e.g. methylcarbonyloxy, benzoyloxy), an acylamino group (e.g. acetoamide, phenylcarbonylamino), a carbamoyl group (e.g. N-methylcarbamoyl, N-phenylcarbamoyl), an alkylsulfoneamide group (e.g. ethylsufonylamino), an arylsulfoneamide group (e.g. phenylsulfoneamino), a sulfamoyl group (e.g. N-propylsulfamoyl, N-phenylsulfamoyl) and an imido group (e.g. succinimido, glutarimido).

n represents 0 or 1.

$Y_1$ represents a ballast group. In the invention, it is preferable to employ a ballast group represented by the following Formula II:

Formula II $$-J-R_4$$

wherein $R_4$ represents an organic group containing one connective group having a carbonyl or sulfonyl unit.

Examples of carbonyl unit-containing group include ester, amido, carbamoyl, ureido and urethane. Examples of sulfonyl unit-containing group include sulfone, sulfoneamido, sulfamoyl and aminosulfoneamide.

J represents

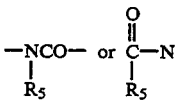

(wherein $R_5$ represents a hydrogen atom, an alkyl group, an aryl group or a heterocyclic group).

Examples of the alkyl group represented by $R_5$ include methyl, ethyl, isopropyl, t-butyl and dodecyl.

Examples of the aryl group represented by $R_5$ include phenyl and naphthyl.

The alkyl group and the aryl group represented by $R_5$ each may have a substituent. The kind of substituent is not critical, but suitable substituents include a halogen atom (e.g. chlorine), an alkyl group (e.g. ethyl, t-butyl), an aryl group (e.g. phenyl, p-methoxyphenyl, napthyl), an alkoxy group (e.g. ethoxy, benzyloxy), an aryloxy group (e.g. phenoxy), an alkylthio group (e.g. ethylthio), an arylthio group (e.g. phenylthio), an alkylsulfonyl group (e.g. β-hydroxyethylsulfonyl), an arylsulfonyl group (e.g. phenylsulfonyl), an acylamino group such as an alkylcarbonylamino group (e.g. acetoamido), an arylcarbonylamino group (e.g. phenylcarbonylamino), a carbamoyl group, a carbamoyl group substituted with an alkyl group (e.g. N-methylcarbamoyl) or an aryl group, preferably phenyl (e.g. phenoxycarbamoyl), an acyl group such as an alkylcarbonyl group (e.g. acetyl) and an arylcarbonyl group (e.g. benzoyl), a sulfoneamide group such as an alkylsulfonylamino group (e.g. methylsulfonylamino) and an arylsulfonylamino group (e.g. benzenesulfonylamino), a sulfamoyl group, a sulfamoyl group substituted with an alkyl group (e.g. N-methylsulfamoyl) or an aryl group, preferably phenyl (e.g. N-phenylsulfamoyl), a hydroxyl group and a cyano group.

In Formula I, $X_1$ represents a group capable of being released upon a coupling reaction with an oxidized color developing agent, for instance, a group represented by the following Formula III or IV. In the invention, it is preferred that $X_1$ be a group represented by Formula IV.

$-OR_6$ Formula III

Formula IV

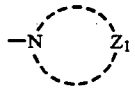

In Formula III, $R_6$ represents an aryl group or a heterocyclic group which may have a substituent.

In Formula IV, $Z_1$ represents a group of non-metallic atoms that are necessary to form a 5- or 6-membered ring together with a nitrogen atom. Examples of a radical needed to form a non-metallic atom group include methylene, methyl, substituted methyl <C=O, $-\overset{|}{N}R_A$ (wherein $R_A$ has the same meaning as $R_5$), —N=, —O—, —S— and $-SO_2-$.

The yellow couplers represented by Formula I may combine with each other at $R_1$, $R_3$ or $Y_1$ to form a bis configuration.

A yellow coupler represented by the following Formula V is preferable in the invention.

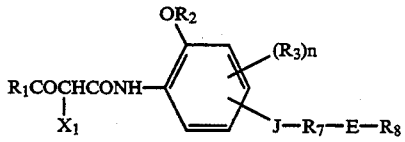

In the formula, $R_1$, $R_2$ and $R_3$ respectively have the same meanings as $R_1$, $R_2$ and $R_3$ in Formula I; J has the same meaning as J in Formula II; n represents 0 or 1; $R_7$ represents an alkylene group, an arylene group, an alkylenearylene group, an arylenealkylene group or $-A-V_1-B-$ (wherein A and B each represent an alkylene group, an arylene group, an alkylenearylene group or an arylenealkylene group; $V_1$ represents a divalent bonding group); $R_8$ represents an alkyl group, a cycloalkyl group, an aryl group or a heterocyclic group; E represents a bonding group having a carbonyl or sulfonyl unit; and $X_1$ represents a group capable of being released upon a coupling reaction with an oxidized developing agent.

Examples of the alkyl group represented by $R_7$ include methylene, ethylene, propylene, butylene and hexylene. The alkyl group represented by $R_7$ may have a substituent. Examples of alkyl-substituted $R_7$ include methyl-methylene, ethyl-ethylene, 1-methyl-ethylene, 1-methyl-2-ethylethylene, 2-decyl-ethylene, 3-hexyl-propylene and 1-benzyl-ethylene, and examples of aryl-substituted $R_7$ include 2-phenyl-ethylene and 3-naphthyl-propylene.

Examples of the arylene group represented $R_7$ include phenylene and naphthylene.

The alkylenearylene group represented by $R_7$ may be methylenephenylene, and the arylenealkylene may be phenylenemethylene.

The alkylene group, the arylene group, the alkylenearylene group and the arylenealkylene group represented by A or B respectively have the same meanings as the alkylene group, the arylene group, the alkylenearylene group and the arylenealkylene group represented by $R_7$ in Formula IV. The divalent bonding group represented by $V_1$ may be —O— or —S—.

$R_7$ is preferably an alkylene group.

Examples of the alkyl group represented by $R_8$ include ethyl, butyl, hexyl, octyl, dodecyl, hexadecyl and octadecyl. The alkyl group may be either linear or branched. The cycloalkyl group represented by $R_8$ may be cyclohexyl.

Examples of the aryl group represented by $R_8$ include phenyl and naphthyl. The heterocyclic group represented by $R_8$ may be pyridyl. The alkyl group, the cycloalkyl group, the aryl group and the heterocyclic group represented by $R_8$ each may have a substituent.

The kind of substituent for $R_8$ is not critical, and use can be made of the same substituent as that for $R_5$. An organic group having a dissociative hydrogen atom with a pKa value of 9.5 or more is preferable as the substituent for $R_8$.

In Formula V, E represents a bonding group having a carbonyl or sulfonyl unit, preferably a group represented by the following Formula VI. Most preferably, E is a bonding group containing a sulfonyl unit.

$-COO-$, 1)

$-\underset{\underset{R}{|}}{N}CO-$, 2)

$-CO\underset{\underset{R}{|}}{N}-$, 3)

$-\underset{\underset{R}{|}}{N}CO\underset{\underset{R'}{|}}{N}-$, 4)

$-\underset{\underset{R}{|}}{N}COO-$, 5)

$-SO_2-$, 6)

$-\underset{\underset{R}{|}}{N}SO_2-$, 7)

-continued $-SO_2\underset{\underset{R}{|}}{N}-$, $-\underset{\underset{R}{|}}{N}SO_2\underset{\underset{R'}{|}}{N}-$ In the formula, R and R' each represent a hydrogen atom, an alkyl group, an aryl group or a heterocyclic group. R and R' may be either identical or different.

Examples of the alkyl group, the aryl group and the heterocyclic group include those mentioned for $R_5$. Each of these groups may have the same substituent as that for $R_5$. A hydrogen atom is preferable as R and R'.

The amount of the yellow coupler represented by Formula I is normally $1\times10^{-3}$ to 1 mol, preferably $1\times10^{-2}$ to $8\times10-1$ mol, per mol silver halide.

Specific examples of the yellow coupler represented by Formula I are given below:

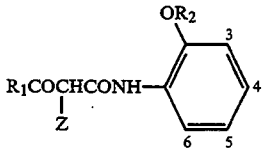

| No. | $R_1$ | $R_2$ | Z |
|---|---|---|---|
| Y-1 | (t)$C_4H_9$— | —$CH_3$ | 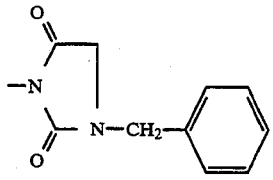 |
| Y-2 | (t)$C_4H_9$— | —$CH_3$ | 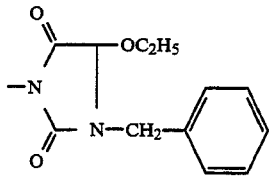 |
| Y-3 | (t)$C_4H_9$— | —$CH_3$ | 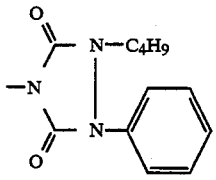 |
| Y-4 | (t)$C_4H_9$— | —$CH_3$ | 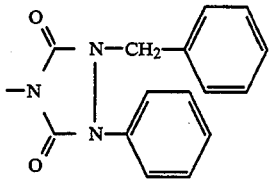 |
| Y-5 | (t)$C_4H_9$— | —$CH_3$ | 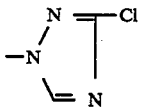 |
| Y-6 | (t)$C_4H_9$— | —$CH_3$ | 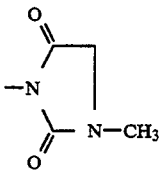 |

-continued
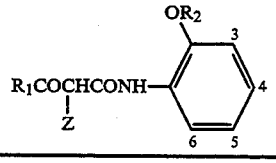
| | | | |
|---|---|---|---|
| Y-7 | (t)$C_4H_9$— | —$CH_3$ | 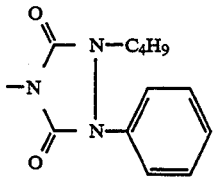 |
| Y-8 | (t)$C_4H_9$— | —$C_3H_7$(iso) | 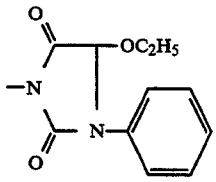 |
| Y-9 | (t)$C_4H_9$— | —$CH_3$ | 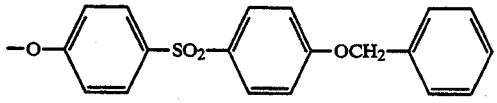 |
| Y-10 | (t)$C_4H_9$— | —$C_{12}H_{25}$ | 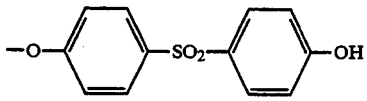 |
| Y-11 | (t)$C_4H_9$— | —$C_{18}H_{37}$ | 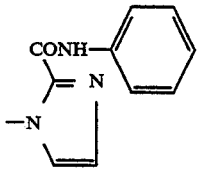 |
| Y-12 | (t)$C_4H_9$— | —$CH_3$ | 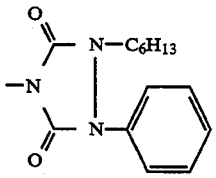 |
| Y-13 | (t)$C_4H_9$— | —$C_4H_9$ | 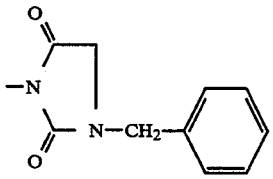 |
| Y-14 | (t)$C_4H_9$— | —$CH_3$ | 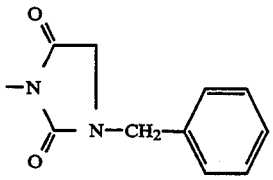 |

-continued
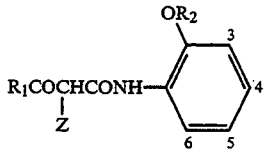
| | | | |
|---|---|---|---|
| Y-15 | $(t)C_4H_9$— | $-CH_3$ | 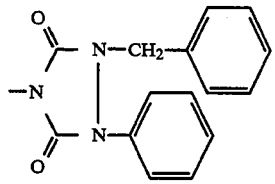 |
| Y-16 | $(t)C_4H_9$— | $-CH_3$ | 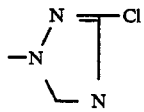 |
| Y-17 | $(t)C_4H_9$— | $-CH_3$ | 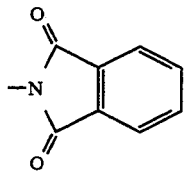 |
| Y-18 | $(t)C_4H_9$— | $-CH_3$ | 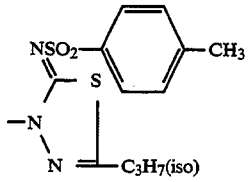 |
| Y-19 | $C_2H_5OCH_2C(CH_3)_2$— | $-CH_3$ | 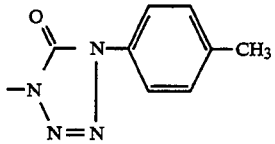 |
| Y-20 | $(t)C_4H_9$— | $-CH_3$ | 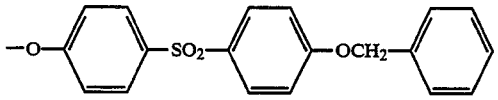 |
| Y-21 | $(t)C_4H_9$— | $-CH_3$ | 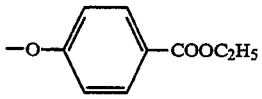 |
| Y-22 | $(t)C_4H_9$— | $-C_{12}H_{25}$ | 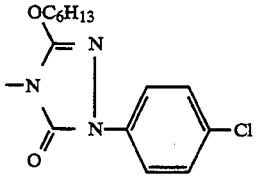 |
| Y-23 | $(t)C_4H_9$— | $-C_2H_5$ | 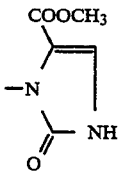 |

-continued
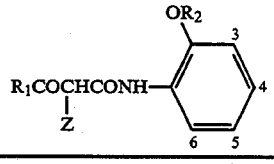
| | | | |
|---|---|---|---|
| Y-24 | 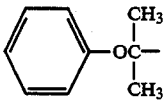 | $-C_4H_9$ | 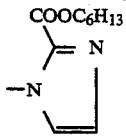 |
| Y-25 | $(t)C_5H_{11}$ | $-C_2H_5$ | H |
| Y-26 | $(t)C_4H_9-$ | $-CH_3$ | 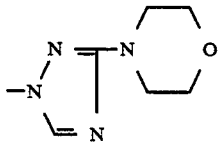 |
| Y-27 | $(t)C_4H_9-$ | $-C_{16}H_{27}$ | 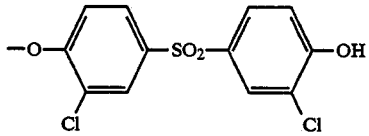 |
| Y-28 | $(t)C_4H_9-$ | $-CH_3$ | 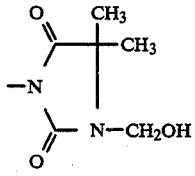 |
| Y-29 | $(t)C_4H_9-$ | $-CH_3$ | 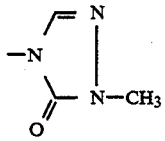 |
| Y-30 | $(t)C_4H_9-$ | $-CH_3$ | 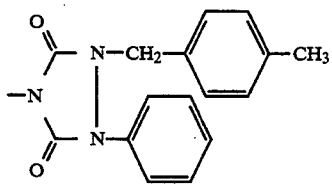 |
| Y-31 | 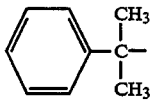 | $-C_{12}H_{25}$ | 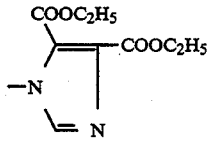 |
| Y-32 | $(t)C_5H_{11}-$ | $-CH_3$ | 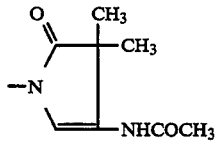 |
| Y-33 | $(t)C_4H_9-$ | $-CH_3$ | 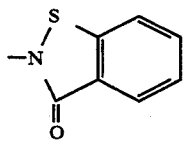 |

-continued
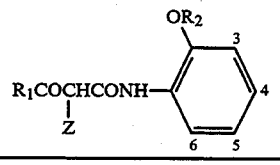
| | | | |
|---|---|---|---|
| Y-34 | (t)$C_4H_9$— | —$CH_3$ | 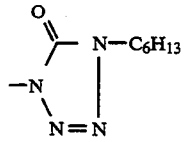 |
| Y-35 | (t)$C_4H_9$— | —$CH_3$ | 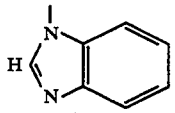 |
| Y-36 | (t)$C_4H_9$— | 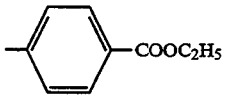 | 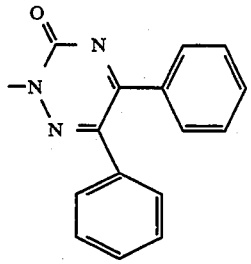 |
| Y-37 | (t)$C_4H_9$— | —$C_4H_9$ | 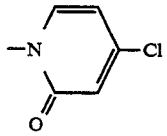 |
| Y-38 | (t)$C_5H_{11}$— | | 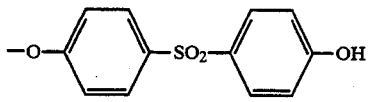 |
| Y-39 | (t)$C_5H_{11}$— | 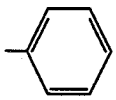 | 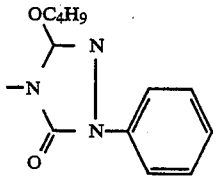 |
| Y-40 | (t)$C_5H_{11}$— | —$CCH_3$ | 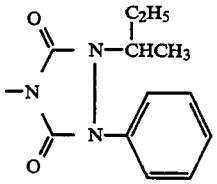 |
| Y-41 | (t)$C_4H_9$— | —$CC_2H_5$ | 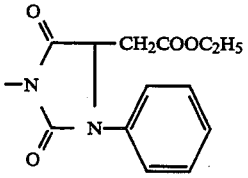 |

-continued
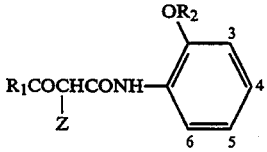
| | | | |
|---|---|---|---|
| Y-42 | (t)$C_4H_9$— | —$CH_3$ | 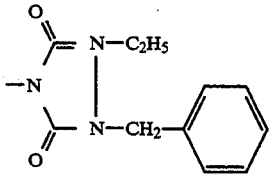 |
| Y-43 | (t)$C_4H_9$— | —$CH_3$ | 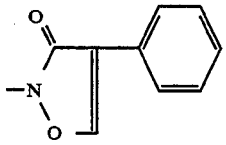 |
| Y-44 | (t)$C_4H_9$— | —$CH_3$ | 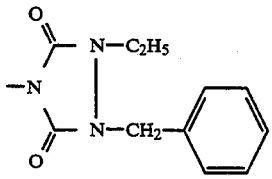 |
| Y-45 | (t)$C_4H_9$— | —$CH_3$ | 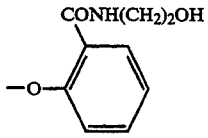 |
| Y-46 | (t)$C_4H_9$— | —$CH_3$ | 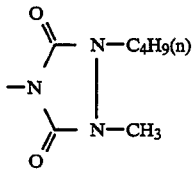 |
| Y-47 | 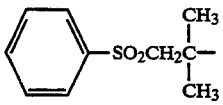 | —$C_2H_5$ | 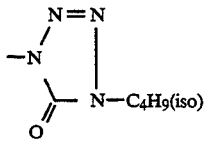 |
| Y-48 | (t)$C_4H_9$— | 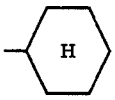 | 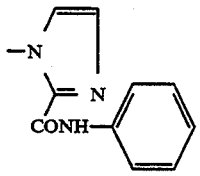 |
| Y-49 | 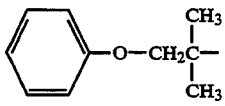 | —$CH_3$ | 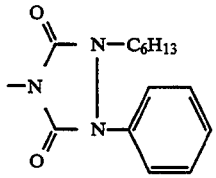 |

-continued
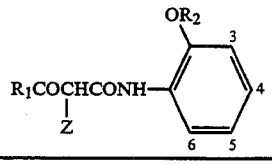
| | | | |
|---|---|---|---|
| Y-50 | (iso)$C_3H_7$— | —$C_4H_9$ | 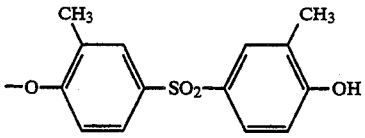 |
| Y-51 | 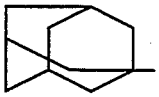 | —$CH_3$ | 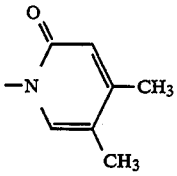 |
| Y-52 | 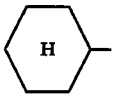 | —$CH_3$ | 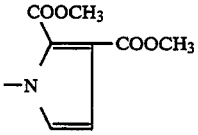 |
| Y-53 | 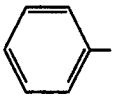 | —$CH_3$ | 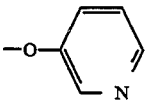 |
| Y-54 | (t)$C_4H_9$— | —$C_{16}H_{33}$ | 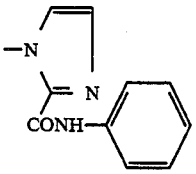 |
| No. | 3 | 4 | 5 | 6 |
|---|---|---|---|---|
| Y-1 | —H | —H | 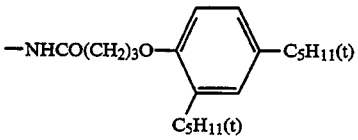 | —H |
| Y-2 | —H | —H | 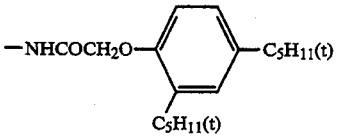 | —H |
| Y-3 | —H | —H | 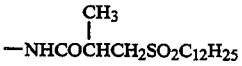 | —H |
| Y-4 | —H | —H | 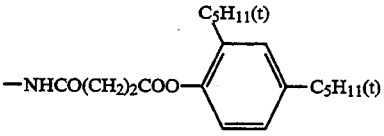 | —H |

-continued
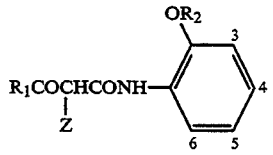
| | | | | |
|---|---|---|---|---|
| Y-5 | —H | —H | $-N(CH_2C_6H_5)-COCH(CH_3)CH_2SO_2C_{18}H_{37}$ | —H |
| Y-6 | —H | —H | $-NHCOCH(CH_3)CH_2SO_2C_{12}H_{25}$ | —H |
| Y-7 | —H | —H | $-NHCO(CH_2)_2CONHC_{12}H_{25}$ ($C_2H_5$) | —H |
| Y-8 | —H | —H | $-NHCO(CH_2)_3COO-C_6H_4-C_{12}H_{25}$ | —H |
| Y-9 | —H | —H | $-CONH-C_6H_4-NHCOC_{12}H_{25}$ | —H |
| Y-10 | —H | —H | $-CONHCH(CH_3)CH_2SO_2C_2H_5$ | —H |
| Y-11 | —H | —H | $-NHCOC(CH_3)_2CH_2SO_2C_4H_9$ | —H |
| Y-12 | —H | —H | $-NHCOCH(CH_3)NHCO-C_6H_4-OC_{12}H_{25}$ | —H |
| Y-13 | —H | —H | $-NHCOCH(C_{12}H_{25})O-C_6H_4-SO_2NHC_4H_9$ | —H |
| Y-14 | —H | —H | $-NHCOCH(CH_3)CH_2SO_2C_{12}H_{25}$ | —H |
| Y-15 | —H | —H | $-CONH(CH_2)_2NHSO_2C_{12}H_{25}$ | —H |
| Y-16 | —H | —H | $-CONHCH(CH_3)CH_2SO_2CH_2CH(C_6H_{13})C_8H_{17}$ | —H |
| Y-17 | —H | —H | $-SO_2NH(CH_2)_3O-C_6H_4(C_5H_{11}(t))-C_5H_{11}(t)$ | —H |

-continued
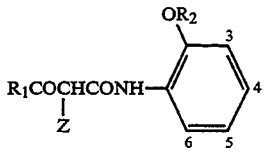
| | | | | |
|---|---|---|---|---|
| Y-18 | —H | —H | 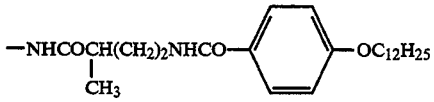 | —H |
| Y-19 | —H | —H | $-NHCO(CH_2)_{10}COOC_2H_5$ | —H |
| Y-20 | —H | —H | 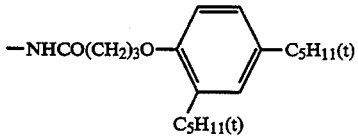 | —H |
| Y-21 | —H | —H | 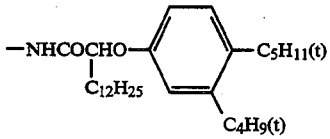 | —H |
| Y-22 | —H | —H | $-NHCO(CH_2)_2SO_2NHCH_2CH(C_2H_5)C_4H_9$ | —H |
| Y-23 | —H | —Cl | 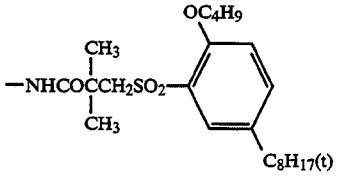 | —H |
| Y-24 | —H | —H | $-NHSO_2C_{16}H_{33}$ | —H |
| Y-25 | —H | —H | 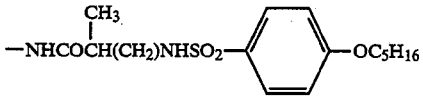 | —H |
| Y-26 | —H | —H | 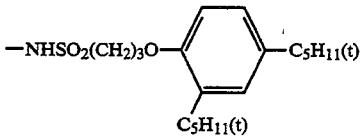 | —H |
| Y-27 | —H | —H | 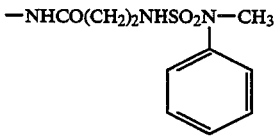 | —H |
| Y-28 | —H | —H | 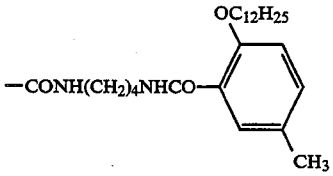 | —H |
| Y-29 | —H | —H | $-CONHCH(C_6H_{13})CH_2SO_2NHC_{12}H_{25}$ | —H |
| Y-30 | —H | —H | $-COOC_{12}H_{25}$ | —H |

-continued

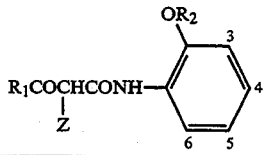

| | | | | |
|---|---|---|---|---|
| Y-31 | —H | —H | —NHCO(CH$_2$)$_3$NHCONHCH$_2$CH(C$_2$H$_5$)C$_4$H$_9$ | —H |
| Y-32 | —H | —H | —CONHCH(C$_6$H$_{13}$)CH$_2$CONH—C$_6$H$_4$—OC$_4$H$_9$ | —H |
| Y-33 | —H | —H | —COOC$_{18}$H$_{35}$ | —H |
| Y-34 | —H | —H | —NHCO(CH$_2$)$_3$NHCOCH$_2$CH(C$_8$H$_{17}$)C$_6$H$_{13}$ | —H |
| Y-35 | —H | —Cl | —NHCOC(CH$_3$)$_2$CH$_2$NHCON(C$_{12}$H$_{25}$)(C$_2$H$_5$) | —H |
| Y-36 | —H | —H | —CONHCH$_2$CH(C$_2$H$_5$)SO—C$_6$H$_4$—C$_{18}$H$_{37}$ | —H |
| Y-37 | —H | —NHCOCH(C$_{16}$H$_{33}$)SO$_2$NHC$_{12}$H$_{25}$ | —Cl | —H |
| Y-38 | —H | —Cl | —NHCO(CH$_2$)$_2$NHCO—C$_6$H$_4$—C$_{12}$H$_{25}$ | —H |
| Y-39 | —H | —H | —CONHC(CH$_3$)$_2$CH$_2$CONH—C$_6$H$_4$—C$_{12}$H$_{25}$ | —H |
| Y-40 | —H | —OCH$_3$ | —NHCOCH(C$_6$H$_5$)(CH$_2$)$_2$NHSO$_2$—C$_6$H$_3$(OC$_{12}$H$_{25}$)—CH$_3$ | —H |
| Y-41 | —H | —H | —COOCH(CH$_3$)COOC$_{12}$H$_{25}$ | —H |
| Y-42 | —H | —H | —CONHC(CH$_3$)(CH$_2$)$_2$COO—C$_6$H$_4$—CH$_3$ | —H |
| Y-43 | —H | —CONH(CH$_2$)$_4$NHSO$_2$CH(CH$_3$)C$_4$H$_9$ | —OCH$_3$ | —H |

-continued

| | | | | |
|---|---|---|---|---|
| | | | 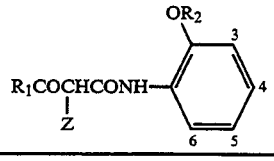 | |
| Y-44 | —H | —H | 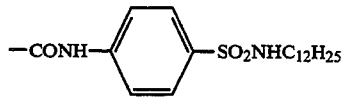 | —H |
| Y-45 | —H | —H | $-COOCH(C_4H_9)COOC_{12}H_{25}$ | —H |
| Y-46 | —H | —H | $-NHCOCH(CH_3)CH_2SO_2C_{12}H_{25}$ | —H |
| Y-47 | —H | —H | $-NHCO(CH_2)_3CON(CH_2C_6H_5)-C_6H_{13}$ | —H |
| Y-48 | —H | —H | 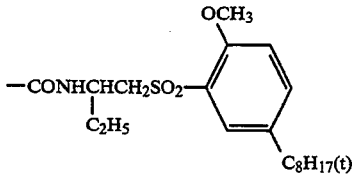 | —H |
| Y-49 | —H | —H | $-CONHCH(C_2H_5)COOC_{12}H_{25}$ | —H |
| Y-50 | —H | —H | 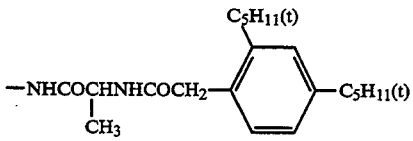 | —H |
| Y-51 | —H | —H | $-NHCO(CH_2)_{10}COOC_2H_5$ | —H |
| Y-52 | —H | —H | 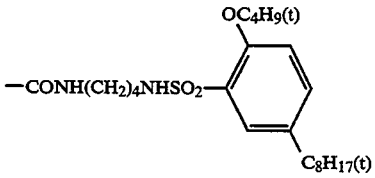 | —H |
| Y-53 | —H | —H | 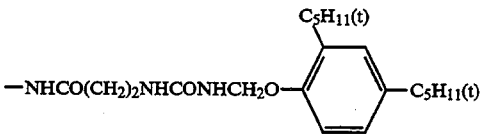 | —H |
| Y-54 | —H | —H | $-SO_2NHCOC_2H_5$ | —H |

A silver halide emulsion to be employed in a light-sensitive material of the invention may be chemically sensitized by a known method.

A silver halide emulsion may contain an antifoggant, a stabilizer or other additives. As a binder, gelatin is useful (other binders may also be employed).

Emulsion layers and other hydrophilic colloidal layers may be hardened, and each may contain a plasticizer and a dispersion (a latex) of a polymer which is insoluble or sparingly soluble in water.

A silver halide emulsion of the color photographic light-sensitive material for photographing of the invention contains conventional color-forming couplers.

In addition to color-forming couplers, use can be made of a colored coupler (for color correction), a competitive coupler and a compound which releases, upon a coupling reaction with an oxidized developing agent, a photographically effective fragment such as a development inhibitor, a development accelerator, a bleaching accelerator, a developing agent, a solvent for a silver halide, a toner, a hardener, a fogging agent, an antifoggant, a chemical sensitizer, a spectral sensitizer and a desensitizer.

A light-sensitive material of the invention may have auxiliary layers such as a filter layer, an anti-halation layer and an anti-irradiation layer. These layers and/or emulsion layers each may contain a dye which is bleached out or removed from a light-sensitive material during development.

A light-sensitive material of the invention may contain a formalin scavenger, a fluorescent brightener, a matting agent, a lubricant, an image stabilizer, a surfactant, an anti-color fogging agent, a development accelerator, a development inhibitor or a bleaching accelerator.

Usable supports include polyethylene-coated paper, polyethylene terephthalate films, baryta paper and cellulose triacetate films.

The present invention can be advantageously applied to a light-sensitive material for printing that has a reflective support.

After exposure to light, a color photographic light-sensitive material of the invention is processed by a conventional method, thereby to obtain a dye image.

EXAMPLES

The present invention will be described in more detail according to the following examples, which should not be construed as limiting the scope of the invention.

Example 1

Preparation of Color Photographic Light-Sensitive Material for Printing

One side of a paper support was coated with polyethylene, and the other side was coated with polyethylene containing titanium dioxide. On the titanium dioxide-containing polyethylene layer of the support, layers of the following compositions were provided. The coating liquids for these layers were prepared by the method described below:

Coating liquid for the 1st layer 60 ml of ethyl acetate was dissolved in the mixture of 26.7 g of a yellow coupler (SY-1), 10.0 g of a dye image stabilizer, 6.67 g of another dye image stabilizer (ST-2), 0.67 g of an additive (HQ-1) and 6.67 g of a high-boiling organic solvent (DNP). The resulting solution was dispersed in 220 ml of an aqueous 10% gelatin solution containing 7 ml of a 20% surfactant (SU-1) by means of an ultrasonic homogenizer, whereby a yellow coupler dispersion was obtained.

The so-prepared dispersion was mixed with a blue-sensitive silver halide emulsion (silver content: 10 g) to obtain a coating liquid for the 1st layer. Other layers were prepared in substantially the same manner as mentioned above except for ingredients.

As a hardener, compound H-1 was added to the coating liquids for the 2nd layer and the 4th layer, and compound H-2 was added to the coating liquids for the 7th layer. As a surfactant, compounds SU-2 and SU-3 were added to each coating liquid for the adjustment of surface tension.

Unless otherwise indicated, the amounts of the ingredients of a light-sensitive material are expressed in gram per square meter of the light-sensitive material.

The compositions of the layers are summarized in Tables 1 and 2.

TABLE 1

| Layer | Ingredient | Amount ($g/m^2$) |
|---|---|---|
| 3rd layer (green-sensitive layer) | Gelatin | 1.40 |
| | Green-sensitive silver chlorobromide emulsion (Em-G) | 0.17 |
| | Magenta coupler (M-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP (dinonyl phthalate) | 0.20 |
| | Anti-irradiation dye (AI-1) | 0.01 |
| 2nd layer (intermediate layer) | Gelatin | 1.20 |
| | Anti-stain agent (HQ-2) | 0.12 |
| | DIDP (diisodecyl phthalate | 0.15 |
| 1st layer (blue-sensitive layer) | Gelatin | 1.20 |
| | Blue-sensitive silver chlorobromide emulsion (Em-B) | 0.26 |
| | Yellow coupler (SY-1) | 0.80 |
| | Dye image stabilizer (ST-1) | 0.30 |
| | Dye image stabilizer (ST-2) | 0.20 |
| | Anti-stain agent (HQ-1) | 0.02 |
| | Anti-irradiation agent (AI-3) | 0.01 |
| | DNP | 0.20 |
| Support | Polyethylene-coated paper | |

The amounts of the silver halides are translated into the amount of silver.

TABLE 2

| Layer | Ingredient | Amount ($g/m^2$) |
|---|---|---|
| 7th layer (protective layer) | Gelatin | 1.00 |
| 6th layer (UV absorbing layer) | Gelatin | 0.40 |
| | UV absorber (UV-1) | 0.10 |
| | UV absorber (UV-2) | 0.04 |
| | UV absorber (UV-3) | 0.16 |
| | Anti-stain agent (HQ-5) | 0.04 |
| | DNP (dinonyl phthalate) | 0.20 |
| | PVP (Polyvinylpyrrolidone) | 0.03 |
| | Anti-irradiation agent (AI-1) | 0.02 |
| 5th layer (red-sensitive layer) | Gelatin | 1.30 |
| | Red-sensitive chlorobromide emulsion (Em-R) | 0.21 |
| | Cyan coupler (C-1) | 0.17 |
| | Cyan coupler (C-2) | 0.25 |
| | Dye image stabilizer (ST-1) | 0.20 |
| | Anti-stain agent (HQ-1) | 0.01 |
| | HBS-1 | 0.20 |
| | DOP (dioctyl phthalate) | 0.20 |
| 4th layer (UV absorbing layer) | Gelatin | 0.94 |
| | UV aborber (UV-1) | 0.28 |
| | UV aborber (UV-2) | 0.09 |
| | UV aborber (UV-3) | 0.38 |
| | Anti-stain agent (HQ-1) | 0.10 |
| | DNP (dinonyl phthalate) | 0.40 |

SY-1
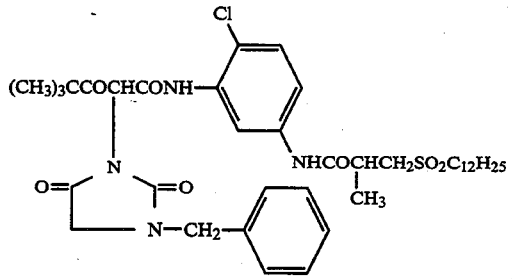
M-1
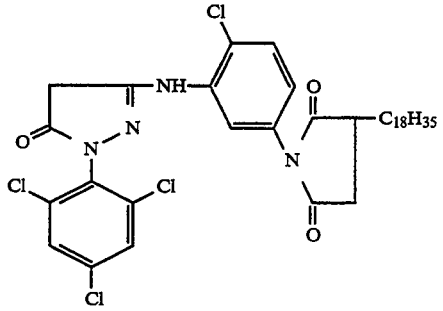
M-2
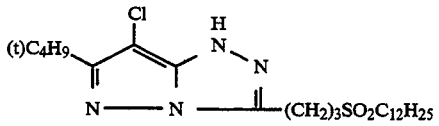
C-1
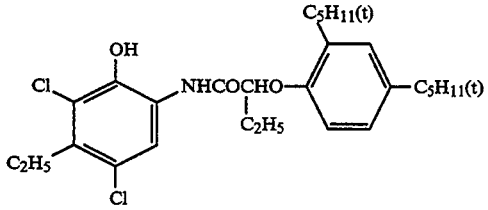
C-2
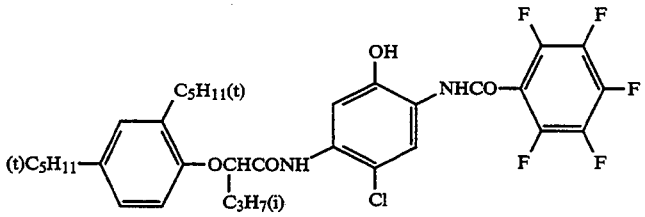
ST-1
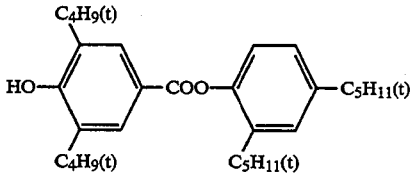
ST-2
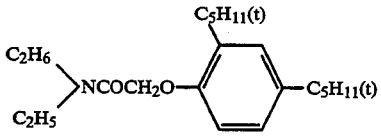
ST-3
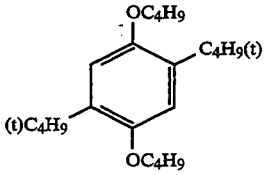

-continued
ST-4
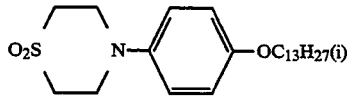
ST-5
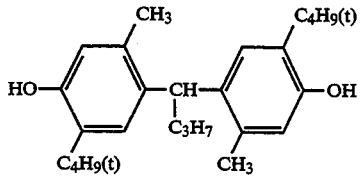
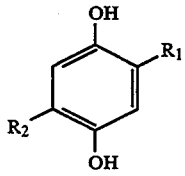
HQ-1
| $R_1$ | $R_2$ |
|---|---|
| (t)$C_8H_{17}$ | (t)$C_8H_{17}$ |
| (s)$C_{12}H_{25}$ | (s)$C_{12}H_{25}$ |
HQ-2
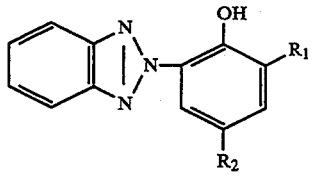
UV-1
| $R_1$ | $R_2$ |
|---|---|
| (t)$C_5H_{11}$ | (t)$C_5H_{11}$ |
| (t)$C_4H_9$ | (t)$C_4H_9$ |
| $C_{12}H_{25}$ | $CH_3$ |
UV-2
UV-3
HBS-1
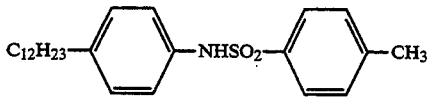
SU-1
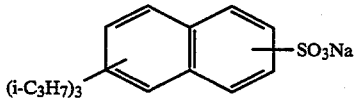
SU-2
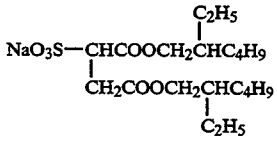
SU-3
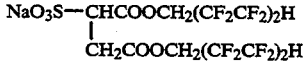
AI-1
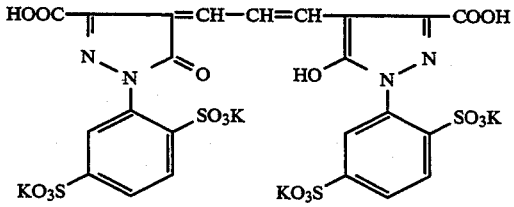

-continued

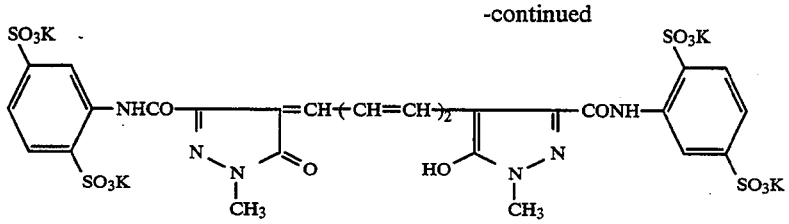

AI-2

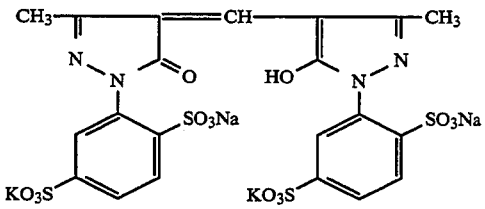

AI-3

$C(CH_2SO_2CH{=}CH_2)_4$ H-1

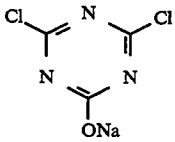

H-2

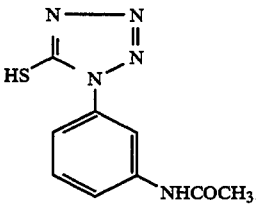

STB-1

Preparation of a blue-sensitive silver halide emulsion

To 1,000 ml of an aqueous 2% gelatin solution that had been heated to 40° C. solution A and solution B were added by the double-jet method over a period of 30 minutes, while controlling pAg and pH to 6.5 and 3.0, respectively. Then, solution C and solution D were added by the double-jet method over a period of 180 minutes, while controlling pAg and pH to 7.3 and 5.5, respectively. The pAg control was performed in accordance with the method described in Japanese Patent O.P.I. Publication No. 45437/1983, and the pH control was conducted with an aqueous solution of sodium hydroxide.

| | |
|---|---|
| Solution A | |
| Sodium chloride | 3.42 g |
| Potassium bromide | 0.03 g |
| Water was added to make the total quantity 200 ml. | |
| Solution B | |
| Silver nitrate | 10 g |
| Water was added to make the total quantity 200 ml. | |
| Solution C | |
| Sodium chloride | 102.7 g |
| Potassium bromide | 1.0 g |
| Water was added to make the total quantity 600 ml. | |
| Solution D | |
| Silver nitrate | 300 g |
| Water was added to make the total quantity 600 ml. | |

After the addition, desalting was performed by using an aqueous 5% solution of DEMOR N (manufactured by Kao Atlas Co., Ltd.) and an aqueous 20% solution of magnesium sulfate. The resultant was then mixed with an aqueous gelatin solution to obtain an emulsion (EMP-1) consisting of monodispersed cubic grains with an average grain size of 0.85 μm, a variation coefficient of 0.07 and a silver chloride content of 99.5 mol %. Using the following compounds, EMP-1 was subjected to chemical ripening at 50 C for 90 minutes, whereby a blue-sensitive silver halide emulsion Em-B was obtained.

| | |
|---|---|
| Sodium thiosulfate | 0.8 mg |
| Chloroauric acid | 0.5 mg |
| Stabilizer STAB-1 | $6 \times 10^{-4}$ mol per mol AgX |
| Sensitizing dye BS-1 | $4 \times 10^{-4}$ mol per mol AgX |
| Sensitizing dye BS-2 | $1 \times 10^{-4}$ mol per mol AgX |

Preparation of green-sensitive silver halide emulsion

EMP-2 was prepared in substantially the same manner as in the preparation of EMP-1, except that the time required for the addition of solutions A and B and the time required for the addition of solutions C and D were changed. EMP-2 was an emulsion consisting of monodispersed cubic grains with an average grain size of 0.43 μm, a variation coefficient of 0.08 and a silver chloride content of 99.5 mol %.

Using the following compounds, EMP-2 was subjected to chemical ripening at 55° C. for 120 minutes, whereby a green-sensitive silver halide emulsion (Em-G) was obtained.

| | |
|---|---|
| Sodium thiosulfate | 1.5 mg |
| Chloroauric acid | 1.0 mg |

-continued

| | |
|---|---|
| Stabilizer STAB-1 | $6 \times 10^{-4}$ mol per mol AgX |
| Sensitizing dye GS-1 | $4 \times 10^{-4}$ mol per mol AgX |

Preparation of red-sensitive silver halide emulsion

EMP-3 was prepared in substantially the same manner as in the preparation of EMP-1, except that the time required for the addition of solutions A and B and the time required for the addition of solutions C and D were changed. EMP-3 was an emulsion consisting of monodispersed cubic grains with an average grain size of 0.50 μm, a variation coefficient of 0.08 and a silver chloride content of 99.5 mol %.

Using the following compounds, EMP-3 was subjected to chemical ripening at 60° C. for 90 minutes, whereby a red-sensitive silver halide emulsion (Era-R) was obtained.

| | |
|---|---|
| Sodium thiosulfate | 1.8 mg |
| Chloroauric acid | 2.0 mg |
| Stabilizer STAB-1 | $6 \times 10^{-4}$ mol per mol AgX |
| Sensitizing dye RS-1 | $1 \times 10^{-4}$ mol per mol AgX |

The structural formulae of the compounds employed for forming the silver halide emulsions are given below:

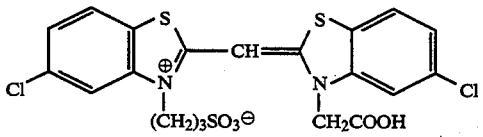

BS-1

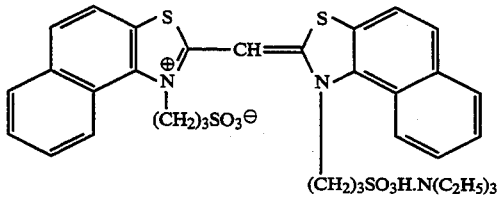

BS-2

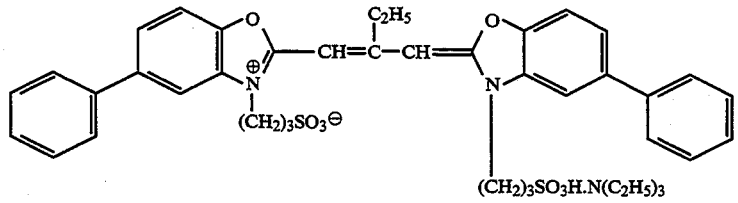

GS-1

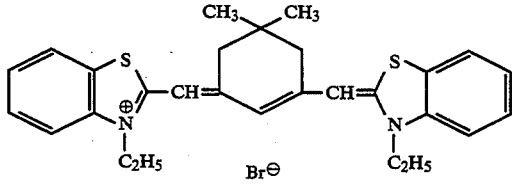

RS-1

Sample 2 was obtained in substantially the same manner as in the preparation of sample 1, except that SY-1 in the 1st layer was replaced by Y-3 and M-1 in the 3rd layer was replaced by M-2. The amounts were unchanged.

Sample 3 was obtained in substantially the same manner as in the preparation of sample 1, except that SY-1 in the 1st layer was replaced by Y-6 and M-1 in the 3rd layer was replaced by M-2. The amounts were unchanged.

Preparation of Color Photographic Light-sensitive Material for Photographing

In the following description, the amounts of the ingredients of a silver halide light-sensitive material are expressed in terms of gram per square meter of the light-sensitive material, unless otherwise indicated. The amounts of a silver halide and colloidal silver were translated into the amount of silver. The amount of a sensitizing dye is expressed in terms of mol per mol silver halide.

On a cellulose triacetate film support, layers of the following compositions were provided in sequence, whereby a multilayer color photographic light-sensitive material (Sample No. 101) was obtained.

| Sample 101 | |
|---|---|
| 1st layer: Anti-halation layer | |
| Black colloidal silver | 0.15 |
| UV absorber (UV-1) | 0.20 |
| High-boiling solvent | 0.20 |
| Oil-1: dioctyl phthalate) | |
| Gelatin | 1.10 |
| 2nd layer: Intermediate layer | |
| Gelatin | 1.00 |
| 3rd layer: Low-speed red-sensitive emulsion layer | |
| Silver iodobromide emulsion | 0.80 |
| (average grain size: 0.25 μm, average AgI content: 8.0 mol %) | |
| Sensitizing dye (SD-1) | $6.0 \times 10^{-4}$ |
| Sensitizing dye (SD-2) | $5.2 \times 10^{-4}$ |
| Cyan coupler (C-1) | 0.60 |
| Colored cyan coupler (CC-1) | 0.12 |
| DIR compound (DD-1) | 0.05 |

-continued

| Sample 101 | |
|---|---|
| DIR compound (DD-3) | 0.005 |
| High-boiling solvent (Oil-1) | 0.50 |
| Gelatin | 0.90 |
| 4th layer: High-speed red-sensitive emulsion layer | |
| Silver iodobromide emulsion (average grain size: 0.40 μm, average AgI content: 7.0 mol %) | 0.90 |
| Sensitizing dye (SD-1) | $2.0 \times 10^{-4}$ |
| Sensitizing dye (SD-2) | $1.7 \times 10^{-4}$ |
| Cyan coupler (C-1) | 0.10 |
| Colored cyan coupler (CC-1) | 0.01 |
| DIR compound (DD-1) | 0.04 |
| DIR compound (DD-3) | 0.003 |
| High-boiling solvent (Oil-1) | 0.15 |
| Gelatin | 0.90 |
| 5th layer: Intermediate layer | |
| Anti-stain agent (SC-1) | 0.10 |
| High-boiling solvent (Oil-2) | 0.10 |
| Gelatin | 1.00 |
| 6th layer: Low-speed green-sensitive emulsion layer | |
| Silver iodobromide emulsion (average grain size: 0.25 μm, average AgI content: 8.0 mol %) | 0.80 |
| Sensitizing dye (SD-3) | $5.85 \times 10^{-4}$ |
| Sensitizing dye (SD-4) | $3.15 \times 10^{-4}$ |
| Magenta coupler (M-1) | 0.53 |
| Colored magenta coupler (CM-2) | 0.09 |
| DIR compound (DD-2) | 0.05 |
| DIR compound (DD-3) | 0.005 |
| High-boiling solvent (Oil-2: tricresyl phosphate) | 0.70 |
| Gelatin | 1.30 |
| 7th layer: High-speed green-sensitive emulsion layer | |
| Silver iodobromide emulsion (average grain size: 0.35 μm, average AgI content: 7.0 mol %) | 0.93 |
| Sensitizing dye (SD-3) | $3.64 \times 10^{-4}$ |
| Sensitizing dye (SD-4) | $1.96 \times 10^{-4}$ |
| Magenta coupler (M-1) | 0.17 |
| Colored magenta coupler (CM-1) | 0.08 |
| DIR compound (DD-2) | 0.05 |
| DIR compound (DD-3) | 0.004 |
| High-boiling solvent (Oil-2) | 0.40 |

-continued

| Sample 101 | |
|---|---|
| Gelatin | 0.90 |
| 8th layer: Yellow filter layer | |
| Yellow colloidal silver | 0.10 |
| Anti-stain agent (SC-1) | 0.10 |
| High-boiling solvent (Oil-2) | 0.10 |
| Gelatin | 1.00 |
| 9th layer: Low-speed blue-sensitive emulsion layer | |
| Silver iodobromide emulsion (average grain size: 0.27 μm, average AgI content: 7.0 mol %) | 0.50 |
| Sensitizing dye (SD-6) | $6.0 \times 10^{-4}$ |
| Yellow coupler (Y-1) | 0.40 |
| Yellow coupler (Y-2) | 0.30 |
| DIR compound (DD-1) | 0.01 |
| High-boiling solvent (Oil-2) | 0.10 |
| Gelatin | 0.90 |
| 10th layer: High-speed blue-sensitive emulsion layer | |
| Silver iodobromide emulsion (average grain size: 0.40 μm, average AgI content: 7.0 mol %) | 0.65 |
| Sensitizing dye (SD-6) | $5.0 \times 10^{-4}$ |
| Yellow coupler (Y-1) | 0.20 |
| High-boiling solvent (Oil-2) | 0.08 |
| Gelatin | 0.55 |
| 11th layer: 1st protective layer | |
| Silver iodobromide fine grain emulsion (average grain size: 0.08 μm) | 0.40 |
| UV absorber (UV-1) | 0.07 |
| UV absorber (UV-2) | 0.10 |
| High-boiling solvent (Oil-1) | 0.07 |
| High-boiling solvent (Oil-3: dibutyl phthalate) | 0.07 |
| Gelatin | 0.60 |
| 12th layer: 2nd protective layer | |
| Alkaline-soluble matting agent (average grain size: 2 μm) | 0.15 |
| Polymethylmethacrylate (average grain size: 3 μm) | 0.04 |
| Lubricant (WAX-1) | 0.04 |
| Gelatin | 0.60 |

The structural formulae of the compounds employed for forming Sample 1 are given below.

Y-1

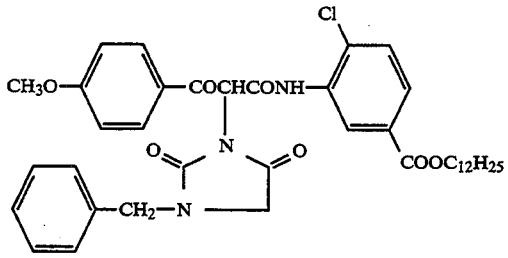

Y-2

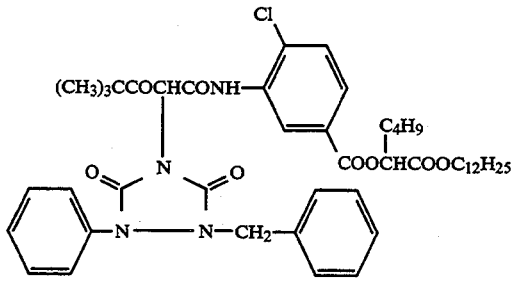

-continued
M-1
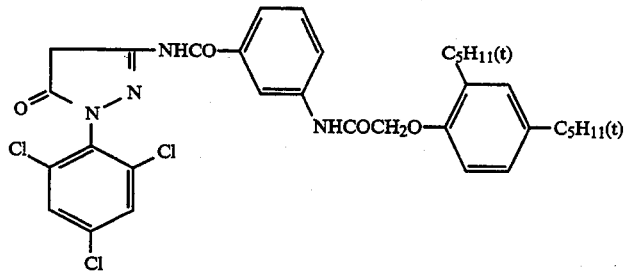
CM-2
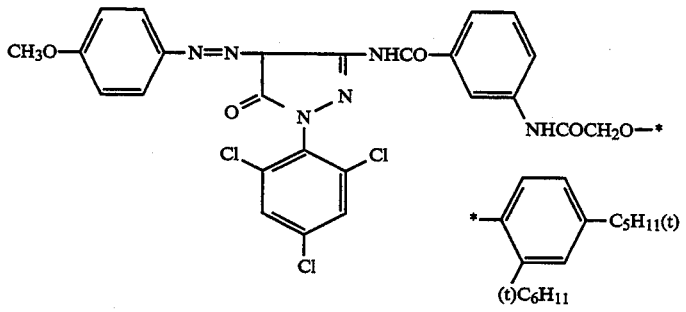
C-1
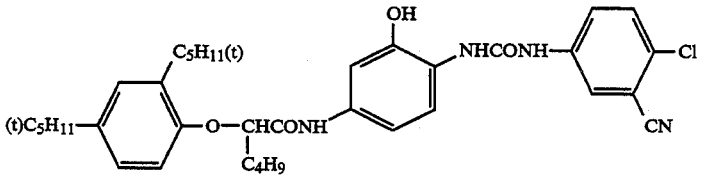
CM-1
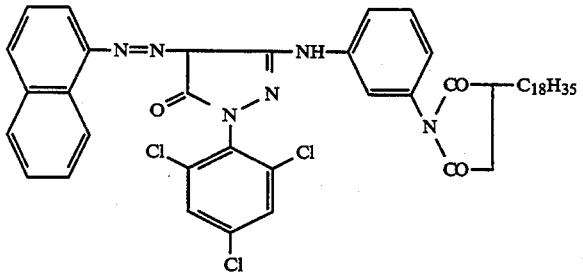
CC-1
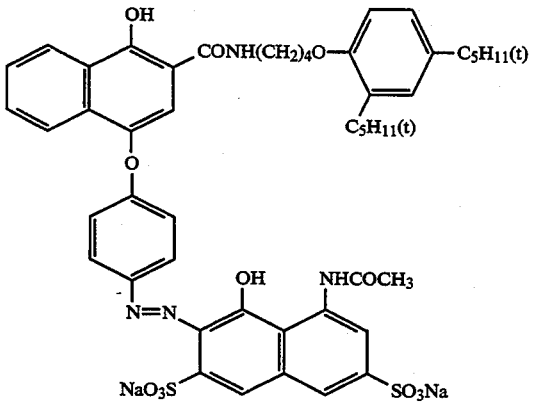

-continued
DD-1
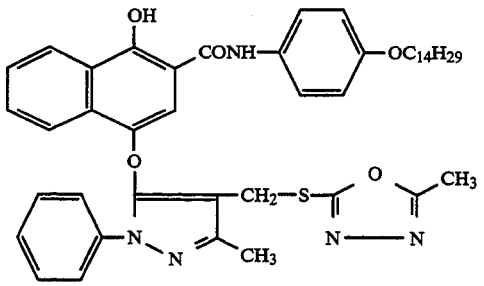
DD-2
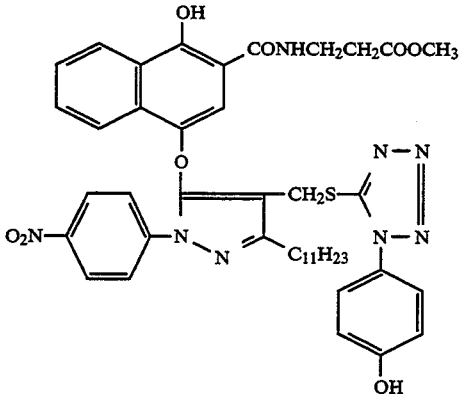
DD-3
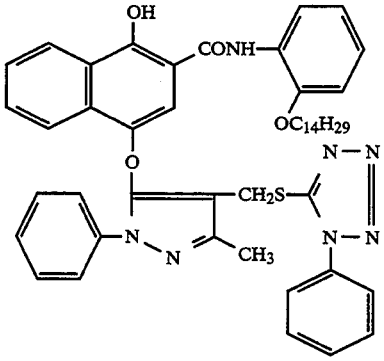
SC-1
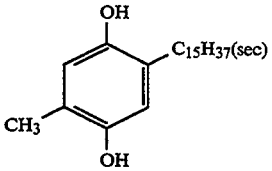
UV-1
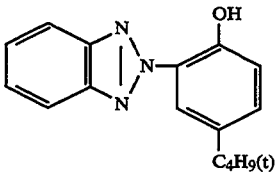
UV-2
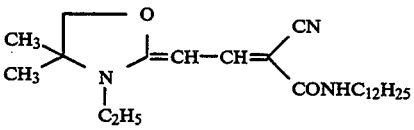

-continued

WAX-1

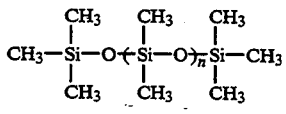

Weight average molecular weight = 3,000

SD-1

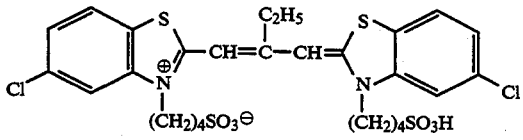

SD-2

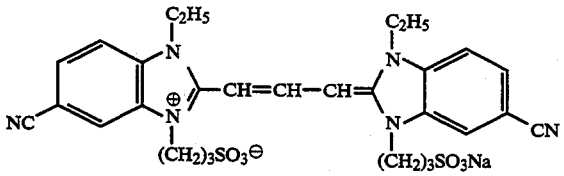

SD-3

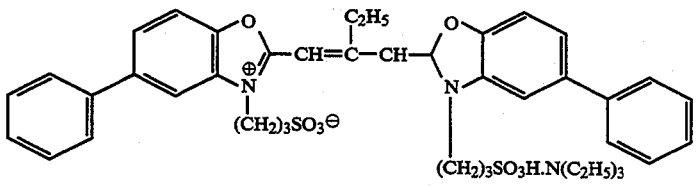

SD-4

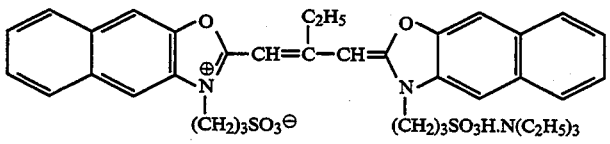

SD-5

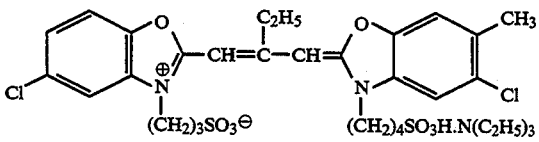

SD-6

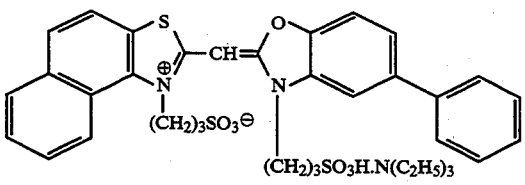

Besides the above ingredients, a coating aid [sodium dioctylsulfosuccinate], a dispersion aid [sodium tri(isopropyl)naphthalenesulfonate], a viscosity controller, a hardener [a sodium salt of 2,4-dichloro-6-hydroxy-s-triazine, di(vinylsulfonylmethyl) ether], a stabilizer (4-hydroxy-6-methyl-1,3,3a,7-tetrazaindene), an anti-foggant [1-phenyl-5-mercapto-tetrazole, poly-N-vinylpyrrolidone (weight average molecular weight: 10,000 and 1,100,000] were added.

Sample Nos. 102 to 104 were prepared in substantially the same manner as in the preparation of sample No. 101, except that the sensitizing dyes in the 6th layer and the 7th layer were replaced by those shown in Table 3. Samples No. 101 to 104 did not differ in the total amount (mol) of the sensitizing dyes.

These samples differ from one another in the combination of the sensitizing dyes and the molar ratio of the two sensitizing dyes.

TABLE 3

| Sample No. | Sensitizing dyes in the 6th and 7th layers (molar ratio) | |
|---|---|---|
| 101 | SD-3 | 65 |
| | SD-4 | 35 |
| 102 | SD-5 | 80 |
| | SD-2 | 20 |
| 103 | SD-5 | 90 |
| | SD-2 | 10 |
| 104 | SD-5 | 92 |
| | SD-2 | 8 |

Emulsions contained in each sample were chemically sensitized to an optimum level by using gold and sulfur sensitizers.

Using these samples, a color rendition chart (manufactured by Macbeth) and a woman in a red sweater were photographed, followed by the processing described below:

| Processing (38° C.) | |
|---|---|
| Color developing | 3 min 10 sec |
| Bleaching | 6 min 30 sec |
| Rinsing | 3 min 15 sec |
| Fixing | 6 min 30 sec |
| Rinsing | 3 min 15 sec |
| Stabilizing | 1 min 30 sec |
| Drying | |

The compositions of the processing liquids are as follows:

| | |
|---|---|
| (Color developer) | |
| 4-amino-3-methyl-N-ethyl-N-(β-hydroxyethyl) aniline sulfate | 4.75 g |
| Anhydrous sodium sulfite | 4.25 g |
| Hydroxylamine sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water was added to make the total quantity 1 liter (pH = 10.1). | |
| (Bleacher) | |
| Ferric (III) ammonium ethylenediamineteteraacetate | 100 g |
| Diammonium ethylenediaminetetraacetate | 0.0 g |
| Ammonium bromide | 50.0 g |
| Glacial acetic acid | 10 ml |
| Water was added to make the total quantity 1 liter and pH was adjusted to 6.0 with aqueous ammonia. | |
| (Fixer) | |
| Ammonia thiosulfate | 175.0 g |
| Anhydrous sodium sulfite | 8.5 g |
| Sodium metasulfite | 2.3 g |
| Water was added to make the total quantity 1 liter, and pH was adjusted to 6.0 with acetic acid. | |
| (Stabilizer) | |
| Formalin (37% aqueous solution) | 1.5 ml |
| Koniducks (manufactured by Konica Corp) | 7.5 ml |
| Water was added to make the total quantity 1 liter. | |

Each sample was exposed to spectral light in 5 nm increments over the wavelength region 300–700 nm, followed by the same processing as mentioned above. For each sample, spectral sensitivity that provided a density higher than the minimum density by 0.7 was measured at each wavelength, and presented as a function of wavelength to obtain a spectral sensitivity distribution curve.

Negative images obtained by the photographing were then printed on each of the light-sensitive materials for printing (sample Nos. 1 to 3), and subjected to the following processing to obtain color photoprints. Printing was performed such that the gray of the color rendition chart would be reproduced to a gray color having the same density.

| Processing | Temperature | Time |
|---|---|---|
| Color developing | 35.0 ± 0.3° C. | 45 sec |

-continued

| | | |
|---|---|---|
| Bleach-fixing | 35.0 ± 0.5° C. | 45 sec |
| Stabilizing | 30–34° C. | 90 sec |
| Drying | 60–80° C. | 60 sec |

| | |
|---|---|
| Color Developer | |
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catecholamine-3,5-diphosphonate | 1.0 g |
| N-ethyl-N-β-methanesulfoneamidoethyl-3-methyl-4-aminoaniline sulfate | 4.5 g |
| Fluorescent brightener (a derivative of 4,4L-diaminostilbene disulfonic acid) | 1.0 g |
| Potassium carbonate | 27 g |
| Water was added to make the total quantity 1 liter, and pH was adjusted to 10.10. | |
| Bleach-fixer | |
| Ferric ammonium ethylenediaminetetraacetate (dihydrate) | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water was added to make the total quantity 1 liter, and pH was adjusted to 5.7 with potassium carbonate or glacial acetic acid. | |
| Stabilizer | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Fluorescent brightner (a derivative of 4,4L-diaminostilbenesulfonic acid) | 1.5 g |

Water was added to make the total quantity 1 liter, and pH was adjusted to 7.0 with sulfuric acid or potassium hydroxide.

Each of sample Nos. 1 to 3 was exposed to monochromatic blue light through a Wratten filter (Model: 98, manufactured by Eastman Kodak), and processed. Exposure was performed in such a manner that the spectral density of a yellow dye formed in each sample would be 1.0 at the peak wavelength.

Using a color analyzer (Model: 607, manufactured by Hitachi Ltd. ), the spectral absorption of the yellow dye formed in the Y layer of each sample was measured, and presented as a function of wavelength to obtain a spectral density distribution curve $S_Y(\lambda)$. From the curve, the wavelength at which the distribution has a maximum value $\lambda_{Ymax}$, and the wavelength in the longer wavelength region at which said maximum value is reduced to half ($\lambda_Y^{50}$) were obtained.

Color photoprints, prepared by a variety of combinations of these color negatives and color papers, were visually examined for their colors. The results of this examination are summarized in Table 4 together with the spectral characteristics of each sample.

TABLE 4

| | Color negative | | | Color paper | | | Color of photoprint | | |
|---|---|---|---|---|---|---|---|---|---|
| Photoprint | Sample No. | $\lambda_{Gmax}$ (nm) | $S_G^{570}/S_{Gmax}$ | Sample No. | $\lambda_{Ymax}$ (nm) | $\lambda_Y^{50}$ (nm) | Yellow | | Invention or comparative |
| A | 101 | 559 | 0.53 | 1 | 446 | 508 | D Yellow tinged with orange | D Skin color tinged with cyan, not healthy | Comparative |
| B | 104 | 554 | 0.12 | 1 | 446 | 508 | D Yellow tinged with orange | C Pink, natural but not | Comparative |

TABLE 4-continued

| Photoprint | Color negative Sample No. | $\lambda_{Gmax}$ (nm) | $S_G^{570}/S_{Gmax}$ | Color paper Sample No. | $\lambda_{Ymax}$ (nm) | $\lambda_Y^{50}$ (nm) | Color of photoprint Yellow | | Invention or comparative |
|---|---|---|---|---|---|---|---|---|---|
| C | 101 | 559 | 0.53 | 2 | 442 | 498 | C Yellow slightly tinged with orange | B healthy D Red tinged with cyan | Comparative |
| D | 102 | 556 | 0.32 | 2 | 442 | 498 | A Yellow without a tinge of orange | D Skin color without a tinge of cyan, natural | Invention |
| E | 103 | 554 | 0.14 | 2 | 442 | 498 | D Yellow without a tinge of orange | C Skin color slightly tinged with pink | Invention |
| F | 104 | 554 | 0.12 | 2 | 442 | 498 | A Yellow without a tinge of orange | A Skin color tinged with pink, healthy | Invention |
| G | 101 | 559 | 0.53 | 3 | 441 | 495 | D Yellow tinged with orange | D Skin color tinged with cyan, not healthy | Comparative |
| H | 104 | 556 | 0.12 | 3 | 441 | 495 | A Yellow without a tinge of orange | A Skin color tinged with pink, healthy | Invention |

Photoprint A prepared by a color negative and a color paper which fall outside the scope of the invention was poor in the reproduction of yellow and skin colors. In the case of photoprint B obtained from a color negative of which the spectral sensitivity characteristics satisfy the requirements of the invention and a color paper of which the spectral density characteristics do not satisfy the requirements of the invention ($\lambda_Y^{50}$ exceeds 50 nm), good results could not be obtained for color reproducibility Photoprint C, obtained from a color paper that falls within the scope of the invention and a color negative that falls outside the scope of the invention, was not satisfactory in color reproduction.

In contrast, in photoprints D, E and F prepared by the method of the invention, both yellow and skin color were reproduced with a high degree of accuracy. In the case of these photoprints, the color of the subject's skin was reproduced to a healthy skin color tinged with pink. The effects of the invention were confirmed also by comparison between photoprints G and H, in which sample No. 3 was used as a color paper instead of sample Nos. 1 and 2.

The $\lambda_{Rmax}$ value of each of sample Nos. 101 to 104 was 620 nm. In each of these samples, the value of $S_G^{570}/S_{Gmax}$ obtained with an exposure that provided a density higher than the minimum density by 0.3 or 1.0 was within the range of 0.05 of that obtained with an exposure that provided a density higher than the minimum density by 0.7.

What is claimed is;

1. A method for forming a silver halide color photographic image comprising;

exposing to light a silver halide color photographic light-sensitive material comprising a support having provided thereon at least one blue-sensitive silver halide emulsion layer, at least one green-sensitive silver halide emulsion layer, and at least one red-sensitive silver halide emulsion layer, to obtain a latent image; processing said material to obtain a color negative image; printing said color negative image on a silver halide color photographic light-sensitive material for printing which comprises a support having provided thereon a yellow color-forming layer, a magenta color-forming layer, and a cyan color-forming layer; and developing said color photographic light-sensitive material for printing to form said color photographic image; wherein:

(A) the spectral sensitivity distribution of the green-sensitive silver halide emulsion layer has a maximum value $S_{Gmax}$ within the wavelength region of 525 to 560 nm, and the spectral sensitivity of the green-sensitive silver halide emulsion layer at 570 nm is 40% or less of said maximum value; and (B) the spectral density distribution of a dye formed in the yellow color-forming layer by processing said color photographic light-sensitive material for printing has a maximum value $S_{Ymax}$ within the wavelength region of 430 to 460 nm, and at a wavelength between 480 to 500 nm, the spectral density of said dye is 50% of said maximum value $S_{Ymax}$.

2. The method of claim 1 wherein said spectral sensitivity distribution of said green-sensitive silver halide emulsion layer has a maximum value within the wavelength region of 530 to 555 nm, and the spectral sensitivity of said green-sensitive silver halide emulsion layer at 570 nm is 20% or less of said maximum value $S_{Gmax}$.

3. The method of claim 1 wherein said yellow color-forming layer comprises a yellow coupler represented by Formula I:

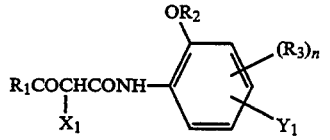

Formula I wherein R, represents alkyl, cycloalkyl, or aryl; $R_2$ represents alkyl, cycloalkyl, acyl or aryl, $R_3$ represents a group capable of being a substituent on a benzene ring; n is 0 or 1; $X_1$ is a group capable of being released upon a coupling reaction with an oxidized developing agent; and $Y_1$ represents a ballast group.

4. The method of claim 1 wherein said yellow color-forming layer comprises a yellow coupler represented by Formula V:

Formula V

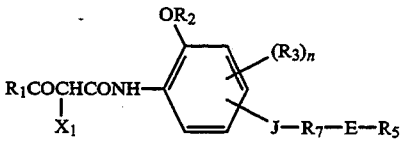

wherein $R_1$ represents alkyl, cycloalkyl, or aryl; $R_2$ represents alkyl, cycloalkyl, acyl, or aryl, $R_3$ represents a group capable of being a substituent on a benzene ring; n is 0 or 1; J represents

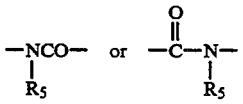

$R_5$ represents hydrogen, alkyl, aryl or a heterocyclic group, $R_7$ represents alkylene, arylene, alkylene arylene, arylene alkylene, or —A—$V_1$—B—, wherein A and B each represent alkylene, arylene, alkylene arylene, or arylene alkylene; $V_1$ represents a divalent bonding group; $R_8$ represents alkyl, cycloalkyl, aryl, or a heterocyclic group; E represents a bonding group having a carbonyl or sulfonyl unit; and $X_1$ represents a group capable of being released upon a coupling reaction with an oxidized developing agent.

5. A method for forming a silver halide color photographic image comprising;

exposing a silver halide color photographic light-sensitive material comprising a support having provided thereon at least one blue-sensitive silver halide emulsion layer, at least one green-sensitive silver halide emulsion layer, and at least one red-sensitive silver halide emulsion layer to light to obtain a latent image; processing said latent image to obtain a color negative image; printing said color negative image on a silver halide color photographic light-sensitive material for printing which comprises a support having provided thereon a yellow color-forming layer, a magenta color-forming layer, and a cyan color-forming layer, and developing the same to obtain said color photographic image wherein;

(A) the spectral sensitivity distribution of the green-sensitive silver halide emulsion layer has a maximum value $S_{Gmax}$ within the wavelength region of 535 to 550 nm, and the spectral sensitivity of the green-sensitive silver halide emulsion at 570 nm is 15% or less of said maximum value; and (B) the spectral density distribution of a dye formed in the yellow color-forming layer by processing said color photographic light-sensitive material for printing has a maximum value $S_{Ymax}$ within the wavelength region of 430 to 460 nm, and at a wavelength between 480 to 500 nm spectral the density of said dye is 50% of said maximum value $S_{Ymax}$.

6. The method of claim 5 wherein said yellow color-forming layer comprises a yellow coupler represented by Formula I:

Formula I

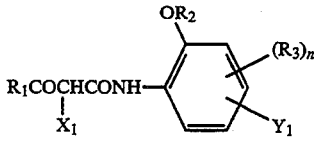

wherein $R_1$ represents alkyl, cycloalkyl, or aryl; $R_2$ represents alkyl, cycloalkyl, acyl or aryl, $R_3$ represents a group capable of being a substituent on a benzene ring; n is 0 or 1; $X_1$ is a group capable of being released upon a coupling reaction with an oxidized developing agent; and $Y_1$ represents a ballast group.

7. The method of claim 5 wherein said yellow color-forming layer comprises a yellow coupler represented by Formula V:

Formula V

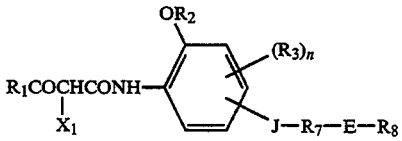

wherein $R_1$ represents alkyl, cycloalkyl, or aryl; $R_2$ represents alkyl, cycloalkyl, acyl, or aryl, $R_3$ represents a group capable of being a substituent on a benzene ring; n is 0 or 1; J represents

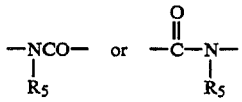

$R_5$ represents hydrogen, alkyl, aryl or a heterocyclic group, $R_7$ represents alkylene, arylene, alkylene arylene, arylene alkylene, or —A—$V_1$—B—, wherein A and B each represent alkylene, arylene, alkylene arylene, or arylene alkylene; $V_1$ represents a divalent bonding group; $R_8$ represents alkyl, cycloalkyl, aryl, or a heterocyclic group; E represents a bonding group having a carbonyl or sulfonyl unit; and $X_1$ represents a group capable of being released upon a coupling reaction with an oxidized developing agent.

* * * * *